US006075508A

United States Patent [19]

Ono et al.

[11] Patent Number: 6,075,508

[45] **Date of Patent: *Jun. 13, 2000**

[54] DISPLAY CONTROL APPARATUS AND METHOD THEREFOR

[75] Inventors: Kenichiro Ono, Kawasaki; Toshiyuki Nobutani, Yokohama; Masami Shimakura, Yokohama; Junichi Tanahashi, Yokohama; Hajime Morimoto, Tokyo; Tatsuya Sakashita, Yokohama; Eiichi Matsuzaki, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/835,806

[22] Filed: Apr. 16, 1997

Related U.S. Application Data

[63] Continuation of application No. 08/519,758, Aug. 28, 1995, abandoned, which is a continuation of application No. 08/114,517, Sep. 1, 1993, abandoned.

[30] Foreign Application Priority Data

Sep. 4, 1992 [JP] Japan ..... 4-237444

[51] Int. Cl.[7] ..... G09G 3/36

[52] U.S. Cl. ..... 345/98; 345/97; 345/103

[58] Field of Search ..... 345/98, 99, 87, 345/100, 185, 196, 200, 97, 103, 507, 515, 516, 517

[56] References Cited

U.S. PATENT DOCUMENTS

| | | | |
|---|---|---|---|
| 4,964,699 | 10/1990 | Inoue | 350/332 |
| 5,091,723 | 2/1992 | Kanno et al. | 345/208 |

FOREIGN PATENT DOCUMENTS

| | | |
|---|---|---|
| 0361471 | 4/1990 | European Pat. Off. . |
| 0368117 | 5/1990 | European Pat. Off. . |
| 0416172 | 3/1991 | European Pat. Off. . |
| 0478382 | 4/1992 | European Pat. Off. . |

*Primary Examiner*—Xiao Wu

*Attorney, Agent, or Firm*—Fitzpatrick, Cella, Harper & Scinto

[57] ABSTRACT

A display control apparatus includes a storage unit for storing display data at each position corresponding to a display screen of a display device, a setting unit for setting a read start position of the display data from the storage unit, and a data supply unit for reading out display data in a predetermined amount from the storage unit on the basis of the read start position set by the setting unit and supplying the readout display data to the display device. The read start position set by the setting unit is set on the basis of the display data stored in the storage unit. A display control method is also disclosed.

16 Claims, 25 Drawing Sheets

| FIG. 3A | FIG. 3B |
|---|---|

VRAM 3
VRAM TOP ADDRESS
IMAGE DATA START ADDRESS
LINE 1
LINE 2
LINE N
PIXEL
(n BYTES)
WRITE INTO VRAM
AT ADDRESS X

FLCD SCREEN
LINE 1
LINE 2
LINE N

DISPLAY CONTROL APPARATUS AND METHOD THEREFOR

This application is a continuation of application Ser. No. 08/519,758, filed Aug. 28. 1995, now abandoned, which is a continuation of application Ser. No. 08/114,517, filed Sep. 1, 1993, now abandoned.

BACKGROUND OF THE INVENTION

1. Field of the Invention

The present invention relates to a display control apparatus and a method therefor and, more particularly, to a display control apparatus and a method therefor, for a display device having a display element which uses, e.g., a ferroelectric liquid crystal as an operating medium for updating a display state and can hold an updated display state upon application or the like of an electric field.

2. Related Background Art

A display device is used as an information display means for achieving a visual information representing function is used in an information processing system or the like. A CRT display device (to be referred to as a CRT hereinafter) is generally used as such a display device.

Various information processing systems such as so-called personal computers are available in accordance with hardware, software, and signal transmission schemes. In this case, display control apparatuses (CRTC) for controlling CRTs, unique to various systems, are used. Such CRTCs are exemplified by a VGA81 (available from IBM) as a VGA (Video Graphics Array) dedicated for an information processing system PC-AT (available from IBM) and an 86C911 (available from S3) as an SVGA (Super VGA) obtained such that an accelerator function for displaying predetermined images such as a circle and a rectangle is added to the VGA.

FIG. 1 is a block diagram showing an SVGA arrangement used in a CRTC.

When the host CPU of an information processing system partially rewrites a display memory window area in a host memory space, the rewritten display data is transferred to a VRAM 3 through a system bus 40 and a SVGA 1. The SVGA 1 generates a VRAM address on the basis of the address of the display memory window area and rewrites the display data in the VRAM 3 which is located at this VRAM address.

Meanwhile, the SVGA 1 accesses the VRAM 3 at the same period as the scan period of the CRT and sequentially reads out display data stored in the VRAM 3. The readout data are transferred to a RAMDAC 2. The RAMDAC 2 sequentially converts the input display data into R, G, and B analog signals and transfers the converted analog signals to a CRT 4. The SVGA used as the CRT display control apparatus functions to unconditionally transfer the display data at a predetermined period to the CRT.

In the above CRT display control, since the VRAM 3 comprises a dual port RAM, the VRAM 3 can independently perform an operation of writing display data in the VRAM 3 to update the display information and an operation of reading out the display data from the VRAM 3. For this reason, the host CPU need not consider display timings and the like at all. Desired display data can be advantageously written at an arbitrary timing.

A CRT requires particularly a length in the direction of thickness of the display screen and has a large volume. It is difficult to obtain a compact CRT as a display device as a whole. This limits the degree of freedom of an information processing system using a CRT as a display. That is, the degrees of freedom in installation locations and portability are decreased.

A liquid crystal display (to be referred to as an LCD hereinafter) can be used as a display device which can compensate for the above drawbacks. More specifically, an LCD can achieve compactness (particularly, a low-profile configuration) of the display device as a whole. Of such LCDs, a display using a liquid crystal cell containing a ferroelectric liquid crystal (to be referred to as an FLC) is available. This display will be referred to as an FLCD hereinafter. One of the characteristic features of the FLCD lies in that the display state of the liquid crystal cell is memorized upon application of an electric field. That is, its liquid crystal cell is sufficiently thin, the elongated FLC molecules in the cell are aligned in the first or second stable state in accordance with an electric field application direction, and the aligned state of the molecules is maintained after the electric field is withdrawn. The FLCD has a memory function due to the above bistable operations of the FLC molecules. The details of the FLC and FLCD are described in U.S. Pat. No. 4,964,699.

Although the FLCD has the above memory function, it has a low FLC display updating speed. The FLCD cannot follow up with changes in display information which must be instantaneously updated. Such operations are exemplified by cursor movement, a character input, and scrolling.

In FLCDs having the above characteristics, various display drive modes which have originated from these characteristics or compensate for these characteristics are available. More specifically, in refresh driving for sequentially and continuously driving scan lines on the display screen as in a CRT and any other liquid crystal display, a relatively large time margin is available in its drive period. In addition to this refresh driving, partial rewrite driving for updating the display state of a part (line) subjected to a change on the display screen and interlace driving for interlacing and driving scan lines on the display screen are also proposed. The display information change speed can be increased by the partial rewrite driving or the interlace driving.

If display control of the FLCD having the above advantages can be performed using an existing CRT display controller, an information processing system using an FLCD as a display device can be arranged at a relatively low cost.

SUMMARY OF THE INVENTION

It is an object of the present invention to provide an FLCD display control apparatus utilizing a CRT display controller and capable of properly performing a halftone process, particularly, in partial rewrite display.

In order to achieve the above object according to the present invention, there is provided a display control apparatus for a display device capable of performing updating of a display state for only a display element subjected to a change in display, comprising display data memory means for storing display data, a display controller capable of sequentially reading out the display data stored in the memory means and transferring the readout display data to the display device at a predetermined period and capable of performing a partial rewrite operation of the display data stored in the memory means, rewrite detecting means for detecting an address for accessing the display data memory means to cause the display controller to perform the partial rewrite operation, data block setting means for setting a block constituted by a predetermined number of display data including the display data having the address detected by the rewrite detecting means, the block constituted by the predetermined number of display data being defined as first display data of the block, and binary means for binarizing the display data of the block set by the data block setting means from the first display data.

With the above arrangement, when the binary process of the display data is to be performed in units of blocks, the first display data of the block is always subjected to a display rewrite operation.

DETAILED DESCRIPTION OF THE PREFERRED EMBODIMENTS

Preferred embodiments of the present invention will be described in detail with reference to the accompanying drawings.

Figure 1:
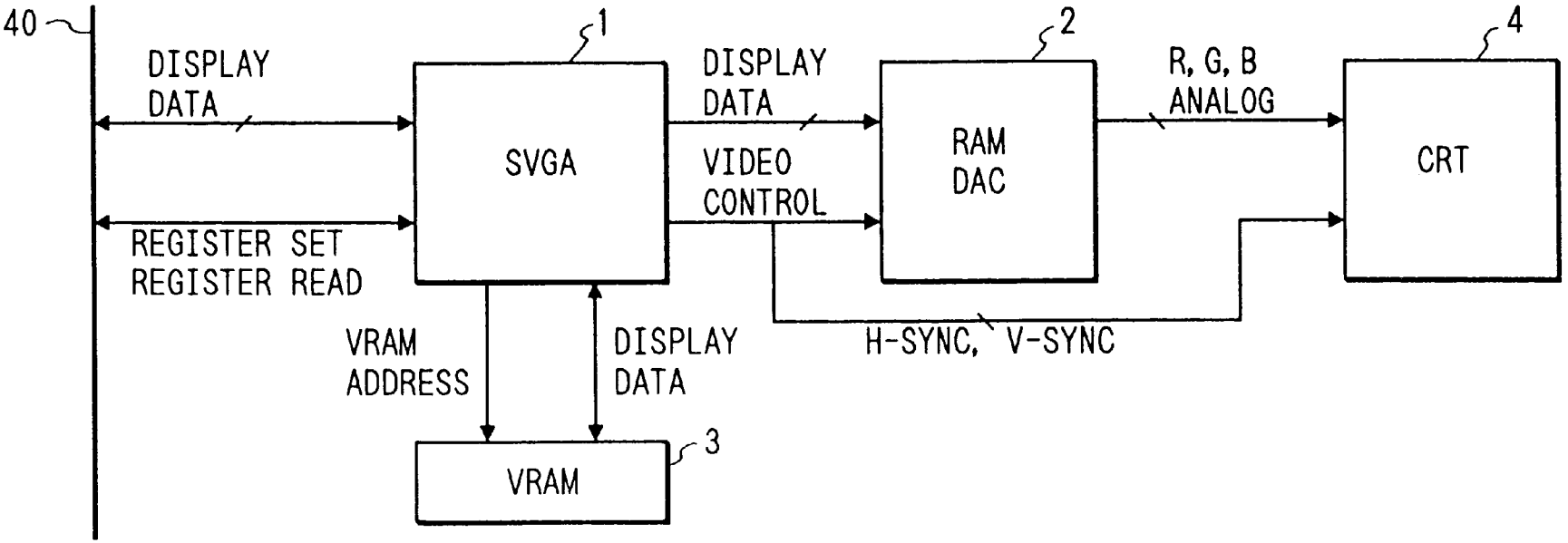
FIG. 1 PRIOR ART
FIG. 1 is a block diagram showing a conventional display control apparatus.
Figure 2:
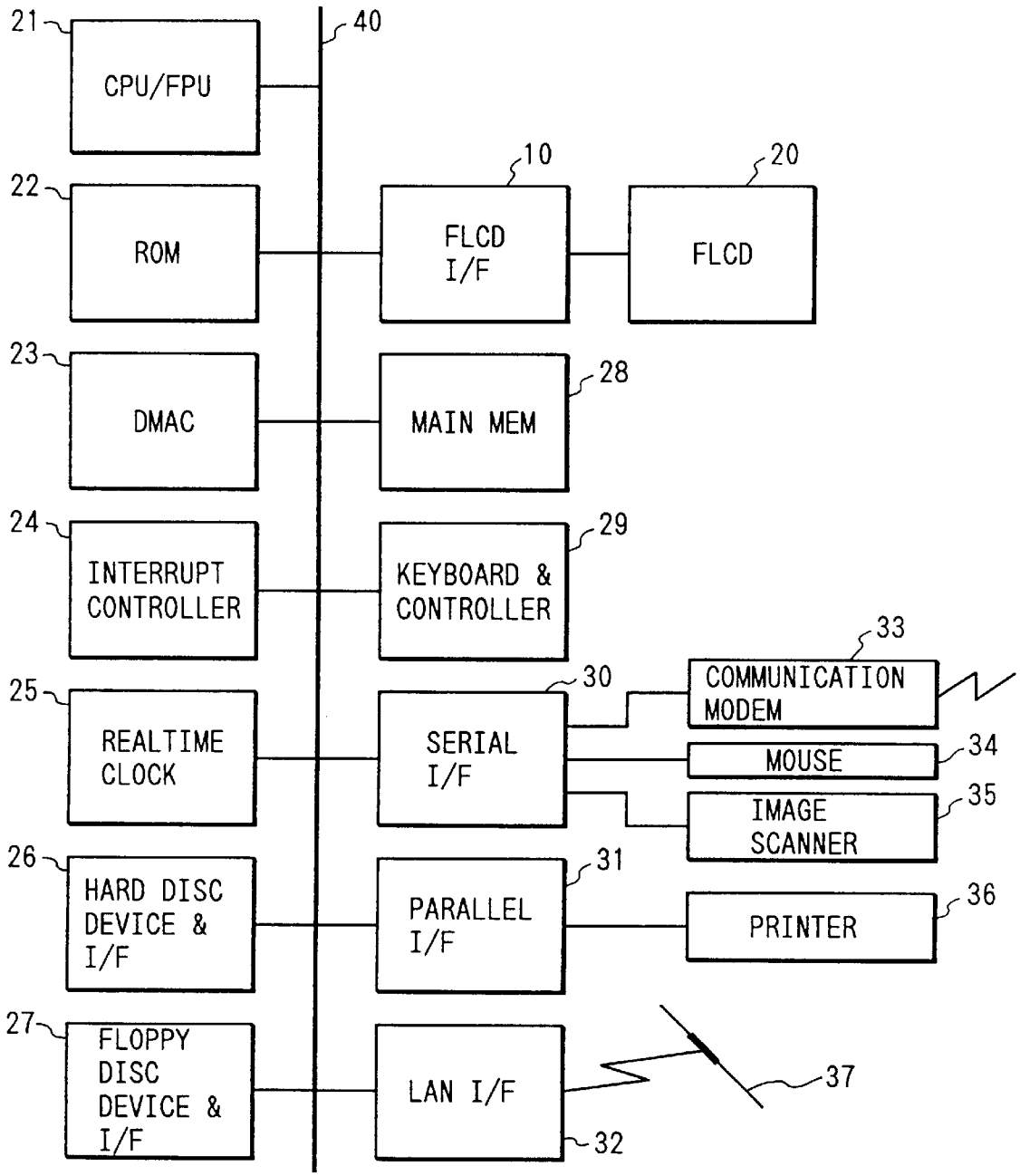
FIG. 2 is a block diagram showing an information processing system according to the first embodiment of the present invention.

FIG. 2 is a block diagram of an information processing system in which an FLC display device having a display control apparatus according to an embodiment of the present invention is used as a display device for displaying various characters and image information.

Referring to FIG. 2, the information processing system includes a CPU 21, a ROM 22, a main memory 28, a DMA controller (Direct Memory Access Controller; to be referred to as a DMAC hereinafter) 23, a LAN (Local Area Network) interface 32, a hard disk device & I/F 26, a LAN 37, a floppy disk device & I/F 27, a printer 36, a parallel I/F 31, a keyboard & controller 29, a communication modem 33, a mouse 34, an image scanner 35, a serial I/F 30, an interrupt controller 24, a real time clock 25, an FLC display device (FLCD) 20, an FLCD interface 10, a system bus 40. The CPU 21 controls the overall information processing system. The ROM 22 stores programs executed by the CPU 21. The main memory 28 is used as a work area or the like in execution of programs. The DMAC 23 transfers data between the main memory 28 and the respective components constituting this system without control of the CPU 21. The LAN I/F 32 serves as an interface between the LAN 37 such as Ethernet (available from XEROX) and this system. The printer 36 can be constituted by an ink-jet or laser beam printer capable of performing recording at a relatively high resolution. The parallel I/F 31 connects signals between the printer 36 and this system. The keyboard & controller 29 inputs information such as character information (e.g., various characters) and control information. The communication modem 33 performs signal modulation between the communication line and this system. The mouse 34 serves as a pointing device. The image scanner 35 reads an image or the like. The communication modem 33, the mouse 34, and the image scanner 35 exchange signals with this system through the serial I/F 30. The interrupt controller 24 controls an interrupt operation in execution of a program. The real time clock 25 controls a timepiece function in this system. The display operation of the FLCD 20 is controlled by the FLCD interface 10 serving as the display control apparatus of this embodiment. The FLCD 20 has a display screen using the ferroelectric liquid crystal as a display operating medium. A display memory window area which can be accessed by the CPU 21 is also developed in the FLCD I/F 10. The system bus 40 comprises a data bus, a control bus, and an address bus to connect signals between the respective components.

In the information processing system in which the above components are connected, a user generally performs operations in correspondence with various kinds of information displayed on the display screen of the FLCD 20. More specifically, character information and image information which are supplied from an external device connected to the LAN 37, the hard disk device & I/F 26, the floppy disk device & I/F 27, the scanner 35, the keyboard & controller 29, and the mouse 34, and operation information stored in the main memory 28 upon operations of the user for the system are displayed on the display screen of the FLCD 20. The user performs information editing and operations for instructing the system while observing the display contents on the FLCD 20. The above components constitute a display information supply means for the FLCD 20.

First Embodiment

Figures 3, 3A:
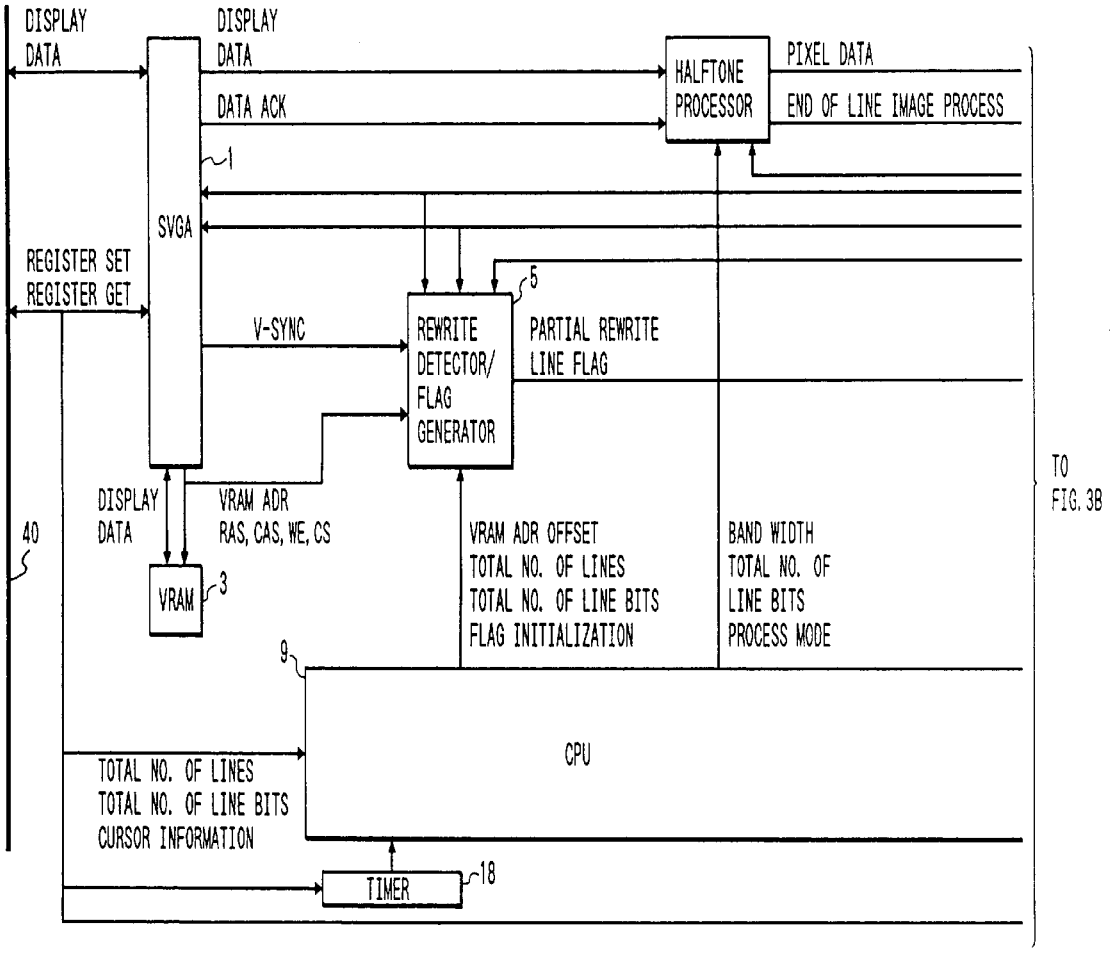
FIG. 3 is comprised of FIGS. 3A and 3B showing block diagrams of a display control apparatus according to the first embodiment of the present invention.
Figure 3B:
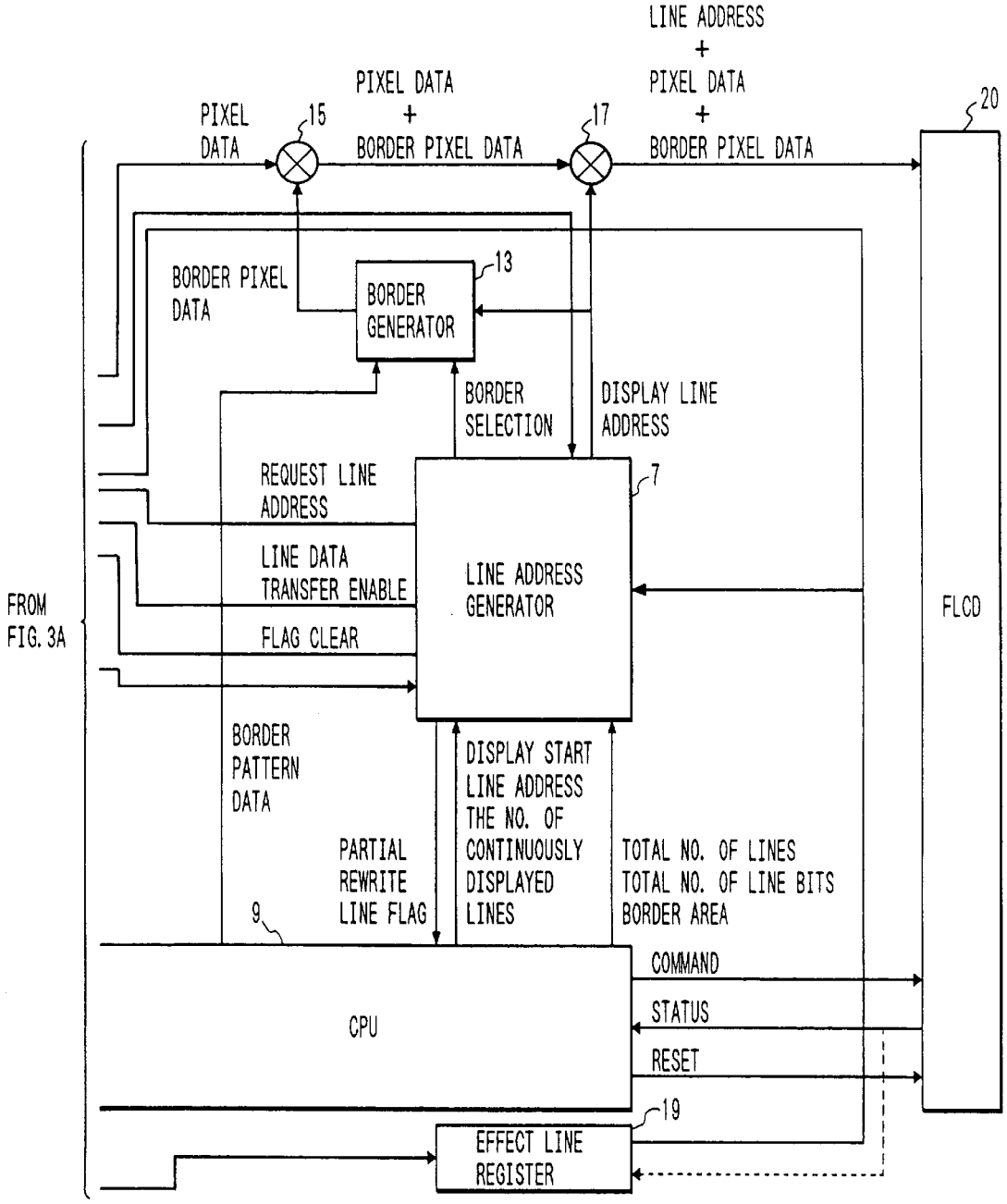

FIGS. 3A and 3B are block diagrams showing the detailed arrangement of the FLCD I/F 10 according to the first embodiment of the present invention;

Referring to FIGS. 3A and 3B, an SVGA 1 using the exiting SVGA serving as a CRT display controller is used in the FLCD I/F 10, i.e., the display control apparatus. The arrangement of the SVGA 1 will be described with reference to FIG. 4.

Figure 4:
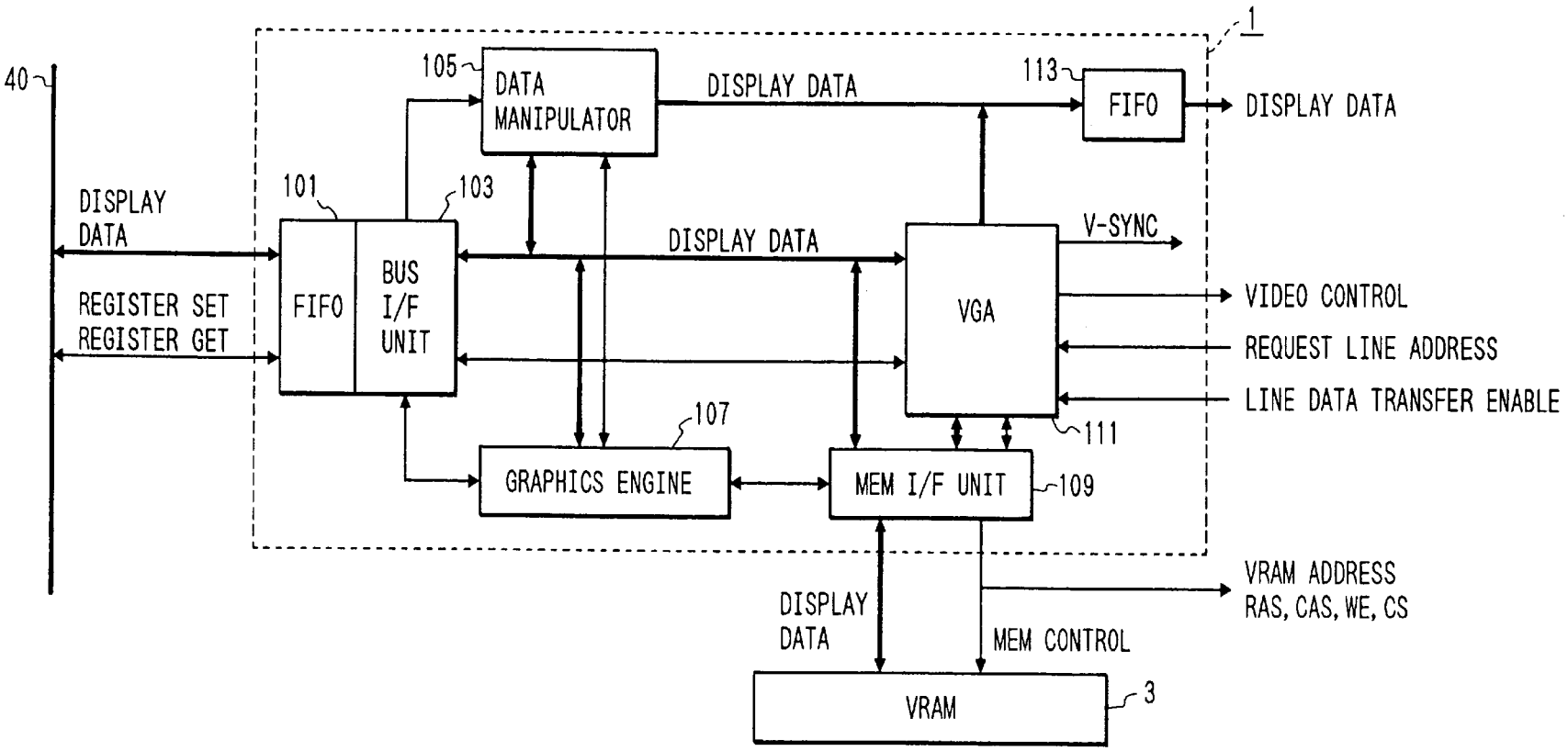
FIG. 4 is a block diagram showing the detailed arrangement of an SVGA shown in FIGS. 3A and 3B.

Referring to FIG. 4, rewrite display data accessed by the host CPU 21 (FIG. 2) to perform a rewrite operation in the display memory window area of the FLCD I/F 10 (FIG. 2) is transferred through the system bus 40 and temporarily stored in a FIFO 101. Bank address data for mapping the display memory window area on an arbitrary area of a VRAM 3 is also transferred through the system bus 40. Display data has a form of 24 bits for expressing 256 gradation levels for each of the R, G, and B components. Control information such as a command and the bank address data from the CPU 21 is transferred in the form of register set data. Register get data for allowing the CPU 21 to detect the state on the SVGA side is transferred to the CPU 21. The register set data and the display data which are stored in the FIFO 101 are sequentially input, so that the registers in a bus I/F unit 103 and a VGA 111 are set in accordance with the output data. The VGA can know a bank address, its display data, and a control command in accordance with the set states of these registers.

The VGA 111 generates a VRAM address for the VRAM 3 on the basis of the address of the display memory window area and the bank address. At the same time, the VGA 111 transfers strobe signals RAS and CAS, a chip select signal CS, and a write enable signal WE, all of which serve as memory control signals, to the VRAM 3 through a memory I/F unit 109, thereby writing the display data at the VRAM address. At this time, the display data to be rewritten is transferred to the VRAM 3 through the memory I/F unit 109.

On the other hand, in response to a line data transfer enable signal transferred from a line address generator 7 (FIGS. 3A and 3B), the VGA 111 reads out the display data from the VRAM 3 which is specified by a request line address transferred from the line address generator 7. The VGA 111 then stores the readout data in a FIFO 113. The display data is sent from the FIFO 113 to the FLCD side in the display data storage order.

The SVGA 1 comprises a data manipulator 105 and a graphics engine 107, both of which provide the accelerator function as previously described, in addition to the cursor display circuit. For example, when the CPU 21 sets data associated with a circle, its center, and its radius in the registers of the bus I/F unit 103 to instruct drawing of the circle, the graphics engine 107 generates circle display data, and the data manipulator 105 writes the resultant data in the VRAM 3.

The SVGA 1 described with reference to FIG. 4 can be obtained by slightly modifying the VGA portion of the existing CRT SVGA.

Referring back to FIGS. 3A and 3B, a rewrite detector/flag generator 5 monitors a VRAM address generated by the SVGA 1 and fetches a VRAM address upon rewriting (writing) of the display data of the VRAM 3, i.e., a VRAM address obtained when the write enable signal and the chip select signal CS go to level "1". The rewrite detector/flag generator 5 calculates a line address on the basis of this VRAM address and data (i.e., a VRAM address offset, the total number of lines, and the total number of line bits) obtained from a CPU 9. The concept of this computation is shown in FIG. 5.

Figures 5A, 5B:
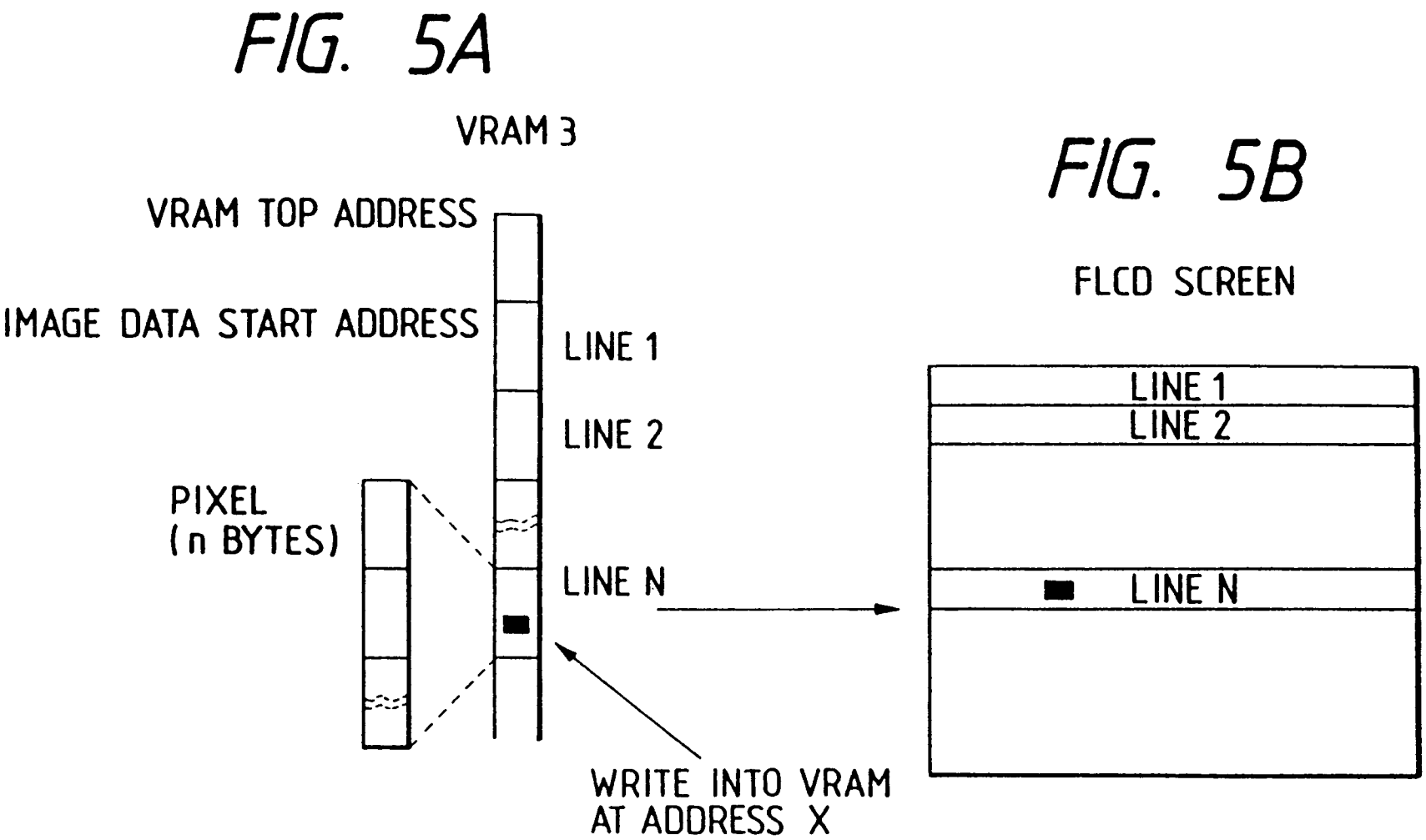
FIGS. 5A and 5B are views for explaining conversion from a VRAM address into a line address according to the first embodiment of the present invention.

As shown in FIGS. 5A and 5B, a pixel represented by an address X in the VRAM 3 corresponds to a line N on the FLCD screen. One line comprises a plurality of pixels, and each pixel is constituted by a plurality (n) of bytes. At this time, the line address (line number N) is computed as follows.

$$\text{Line No. N} = \frac{(\text{VRAM Address X}) - (\text{Image Data Start Address})}{(\text{Number of Pixels per Line}) \times (\text{Number of Bytes per Pixel})} + 1$$

The rewrite detector/flag circuit 5 sets its internal partial rewrite line flag register in accordance with the computed line address. This state is shown in FIG. 6.

Figure 6:
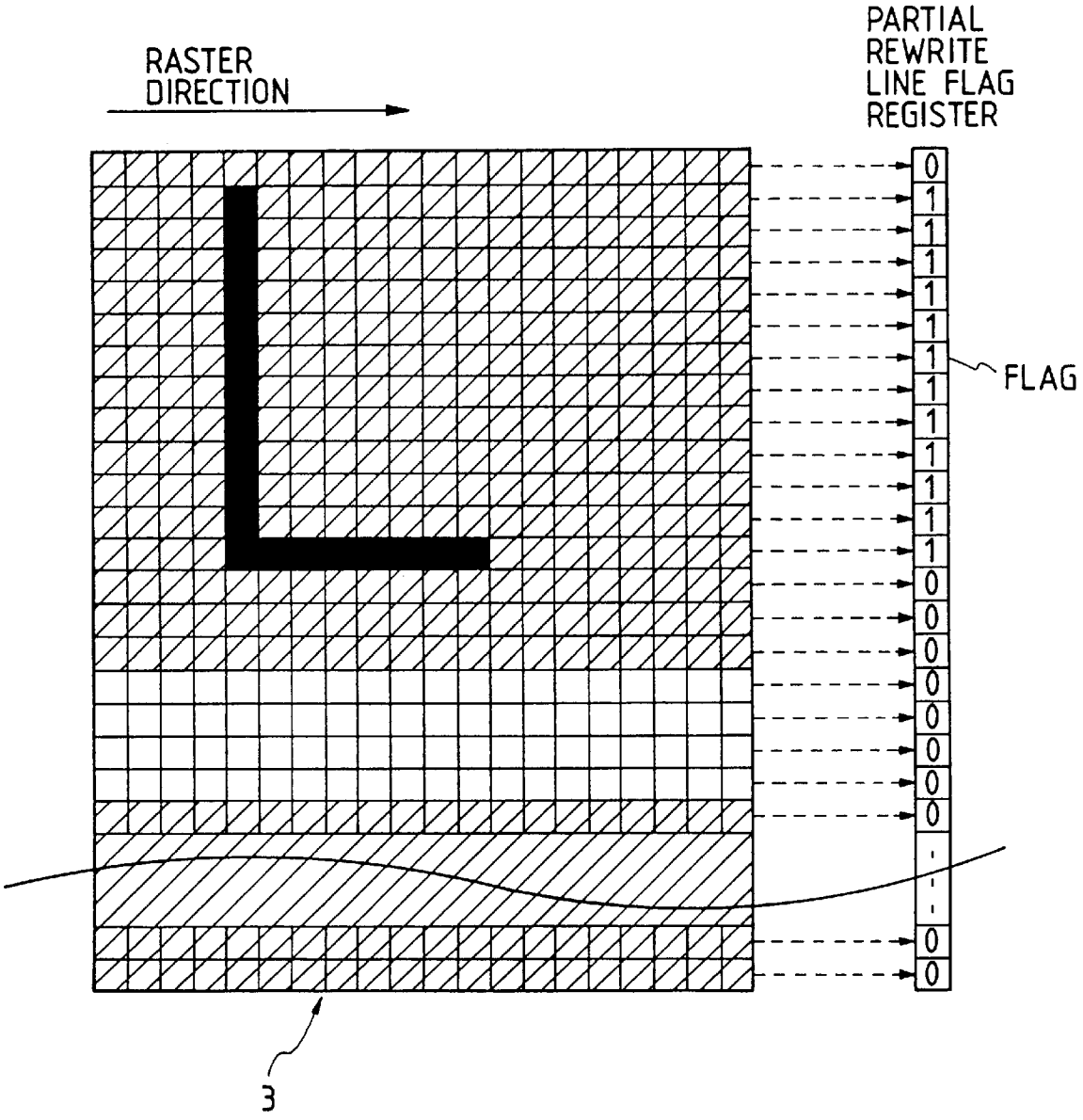
FIG. 6 is a view illustrating a relationship between a rewrite display pixel and a rewrite line flag register according to the first embodiment of the present invention.

As is apparent from FIG. 6, when the address display corresponding to a letter, e.g., "L" in the VRAM 3 is rewritten to display the letter "L", the line address rewritten by the above computation is detected, and a flag is set ("1") in a register corresponding to this address.

The CPU 9 reads the contents of the rewrite line flag register in the rewrite detector/flag generator 5 and sends the line address, the flag of which is set, to the SVGA 1. In this case, when blocks of a plurality of lines are to be partially rewritten, the rewritten top line address (display start line address) and the line address range (i.e., the continuous number of display lines) designated in an effect line address are output to the SVGA 1. At this time, a line data transfer enable signal corresponding to the line address data is output, and the line address generator 7 transfers the display data of the above address from the SVGA 1 (of the FIFO 113) to a halftone processor 11.

Figure 7A:
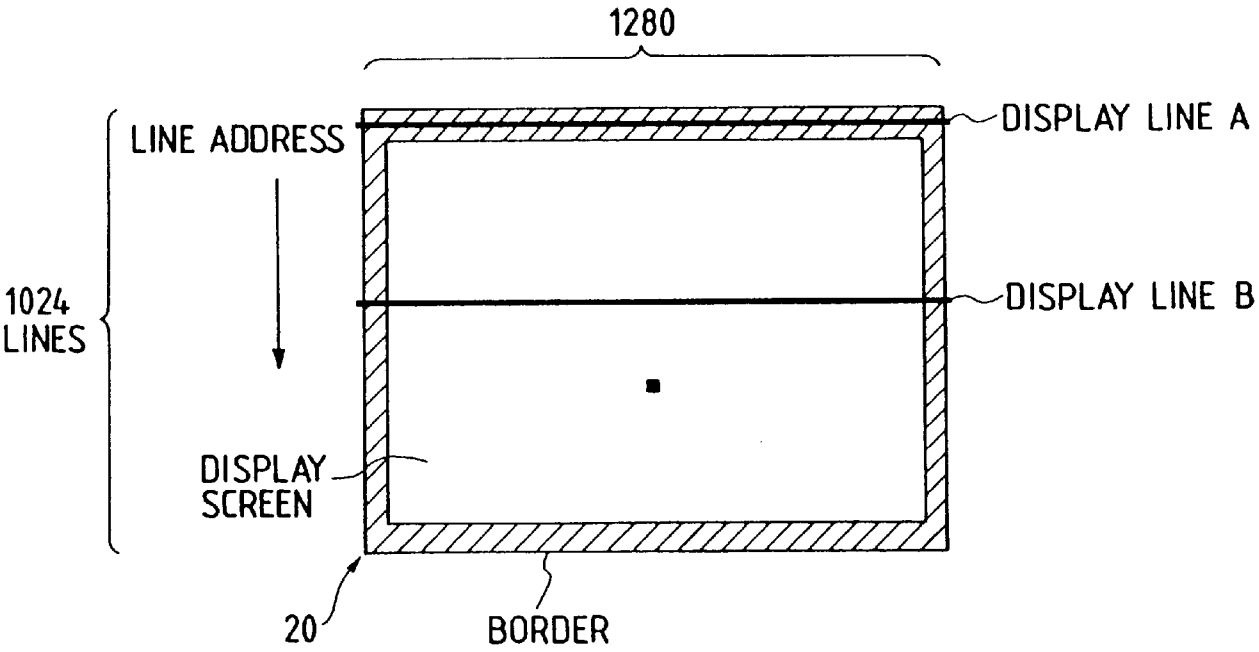
FIGS. 7A and 7B are views illustrating an FLCD display screen according to the first embodiment of the present invention.
Figure 7B:
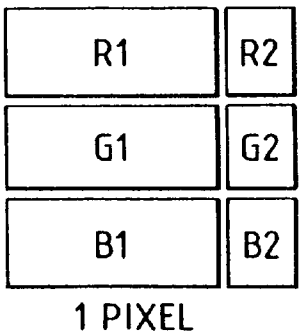

The halftone processor 11 converts multi-value (256 gradation levels) data expressed by 8-bit R, G, and B data into binary pixel data corresponding to each pixel on the display screen of the FLCD 20. As shown in FIGS. 7A and 7B, one pixel on the display screen has display cells having different areas for the respective colors, and data corresponding to one pixel has two bits for each color (R1, R2, G1, G2, B1, and B2). Therefore, the halftone processor 11 converts 8-bit display data into binary data having two bits for each color (i.e., four-value data for each color).

The halftone processor 11 of this embodiment defines several lines designated by the effect line register as one block, binarizes the display data from the SVGA 1, and outputs pixel data for each line. At the same time, an end-of-line-image process signal which represents the end of binary process is output to the line address generator 7 for each line. Note that a data ACK signal input to the binary processor 11 represents the head of the data of each line from the SVGA 1.

The schematic data flow until data is converted into FLCD display pixel data as described above is shown in FIG. 9.

Figure 9:
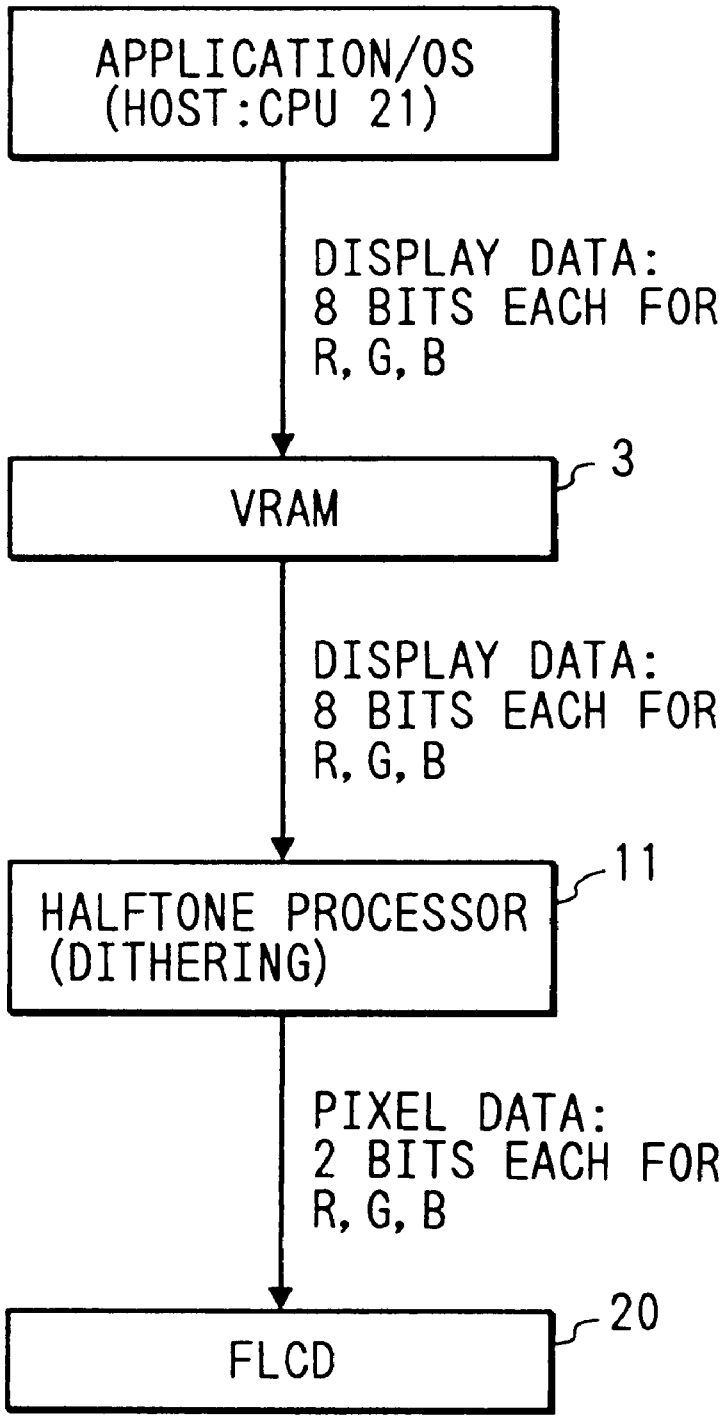
FIG. 9 is a block diagram showing a process flow of display data according to the first embodiment of the present invention.

As is apparent from FIG. 9, display data in the VRAM 3 are stored as 8-bit multi-value data for each of the R. G, and B components. When these data are to be read out and displayed, they are binarized. The host CPU 21 (FIG. 2) can access the FLCD 20 in the same manner as in use of the CRT, thereby assuring compatibility with the CRT.

A technique used in halftone processing can be a known technique such as an error diffusion method, a mean density method, or a dither method. The error diffusion method (ED method) is suitably used in the binary process for each block in this embodiment.

Referring to FIGS. 3A and 3B, a border generator 13 generates pixel data of a border portion on the display screen of the FLCD. More specifically, as shown in FIG. 7, the display screen of the FLCD 20 has 1,024 lines each consisting of 1,280 pixels. The border portion of the display screen which does not contribute to display is formed to surround the remaining display screen portion.

Figure 8A:
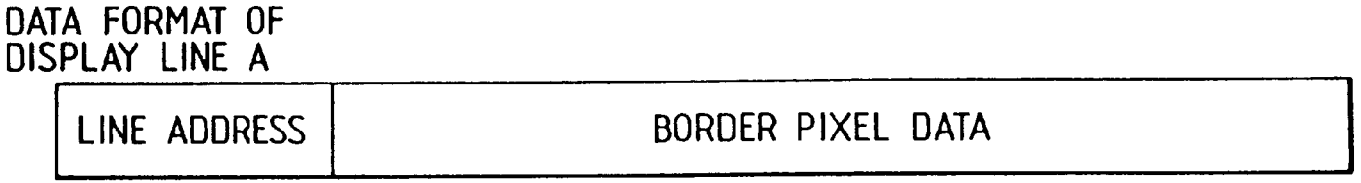
FIGS. 8A, 8B and 8C illustrate data formats of display data according to the first embodiment of the present invention.
Figure 8B:
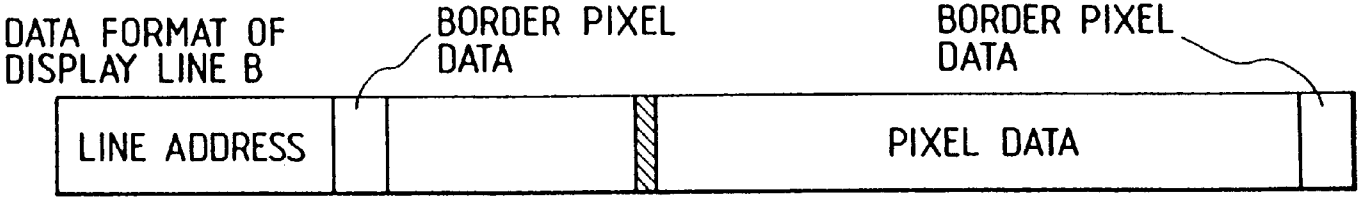
Figure 8C:
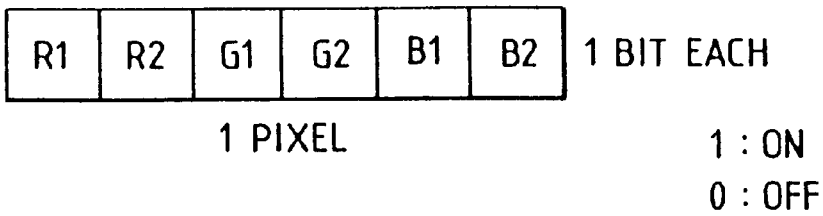

The format of pixel data transferred to the FLCD 20 is defined as the one shown in FIG. 8A or 8B due to the presence of this border portion. FIG. 8A is the data format of a display line A (FIG. 7), i.e., all display lines included in the border portion. FIG. 8B is the data format of a display line B (FIG. 7), i.e., lines used for display. The data format of the display line A starts with a top line address, and border pixel data follows the top line address. To the contrary, since two end portions of the display line B are included in the boarder portion, its data format starts with a line address, and border pixel data, pixel data, and border pixel data follow the line address in the order named.

The border pixel data generated by the border generator 13 is synthesized with pixel data from the halftone processor 11 in a synthesizing circuit 15. The synthesized data is further synthesized with the display line address from the line address generator 7 by a synthesizing circuit 17. The resultant data is sent to the FLCD 20.

A value corresponding to the number of line data binarized for each block in the halftone processor 11 is set in the effect line register 19 by the host CPU 21. The above register value corresponding to the temperature information from the FLCD 20 may be set in place of the above value. A timer 18 counts a time during which a rewrite operation in the VRAM 3 is not performed. When a predetermined count time has elapsed, the CPU 9 sends a signal representing the continuous number of display lines to the line address generator 7 to perform refresh display.

The CPU 9 performs the overall operations described above. More specifically, the CPU 9 receives various kinds of information, i.e., the total number of lines of the display screen, the total number of line bits, and the cursor information from the host CPU 21 (FIG. 2). The CPU 9 sends out various data, i.e., the VRAM address offset, the total number of lines, and the total number of line bits to the rewrite detector/flag generator 5 and initializes the line flag register. The CPU 9 also sends out the display start line address, the continuous number of display lines, the total number of lines, the total number of line bits, and border area information to the line address generator 7 and receives partial rewrite line flag information from the line address generator 7. The CPU 9 further sends out data, i.e., a band width, the total number of line bits, and a process mode to the halftone processor 11 and the boarder pattern data to the border generator 13.

The CPU 9 receives status signals (e.g., temperature information and a Busy signal) from the FLCD 20 and sends out a command signal and a reset signal to the FLCD 20.

Partial rewrite display control and refresh display control of the FLCD I/F 10 described with reference to FIG. 3 will be described below.

Figure 10:
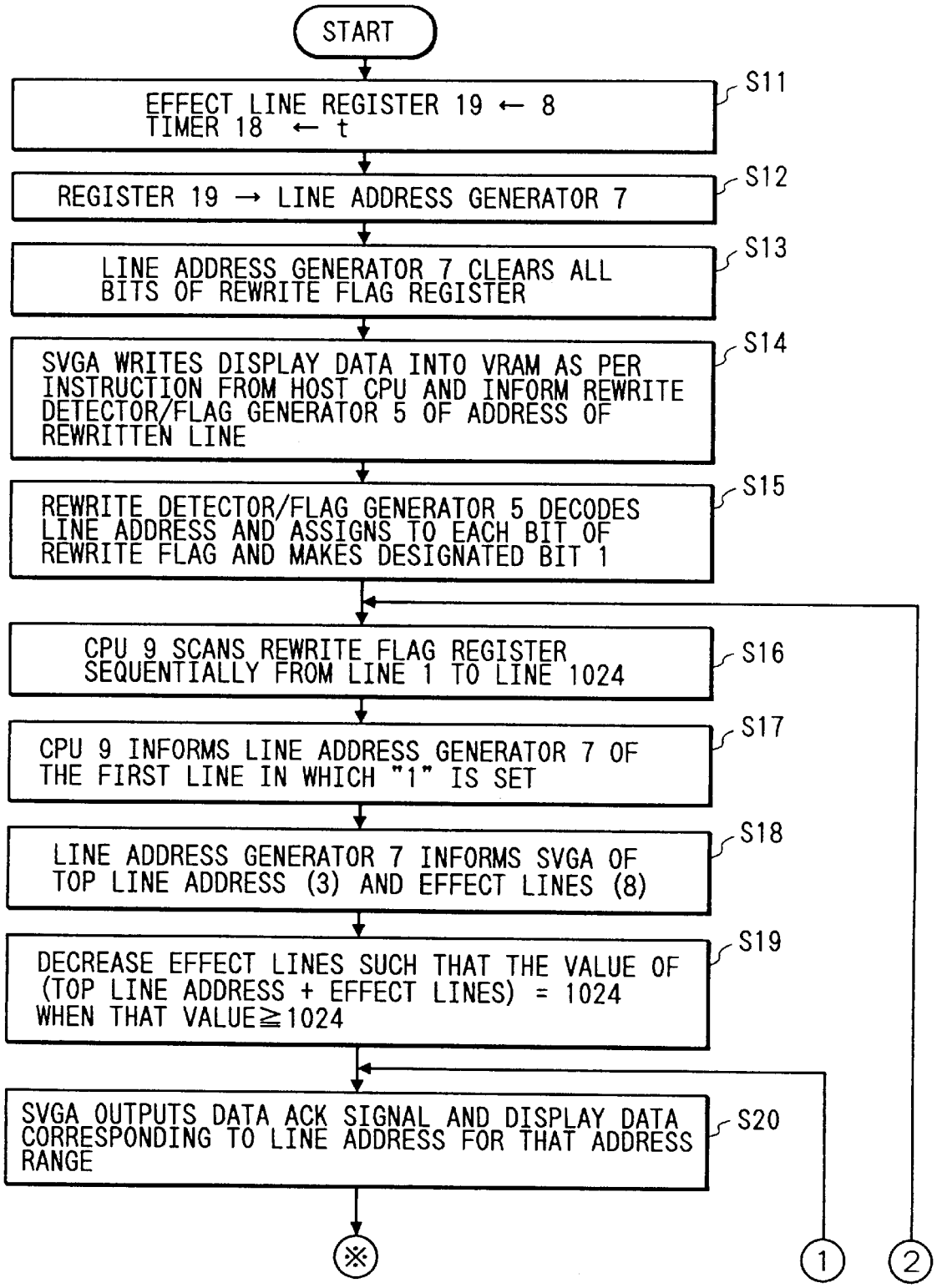
FIG. 10 is a flow chart showing the process flow of the display control apparatus according to the first embodiment of the present invention.
Figure 11:
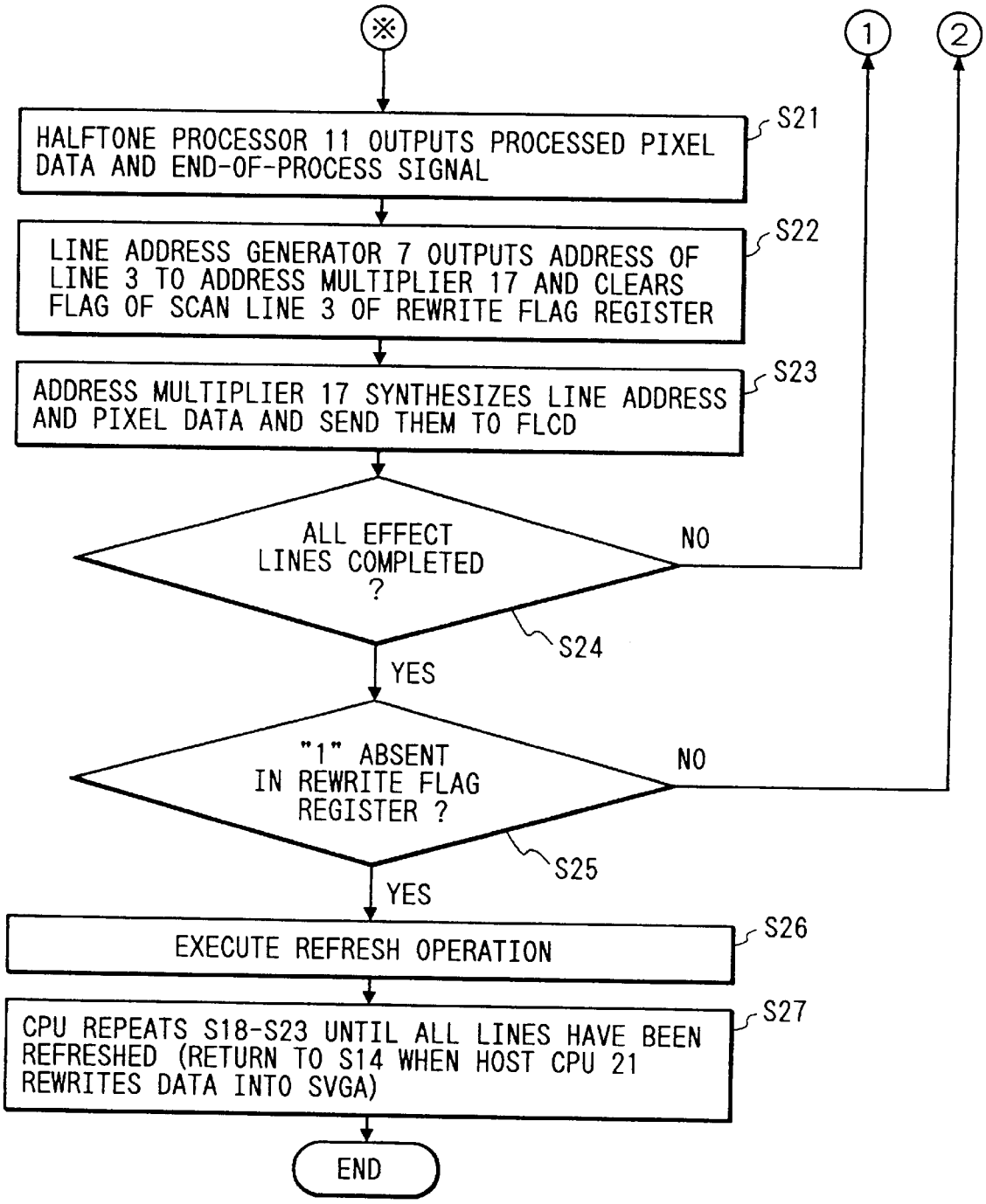
FIG. 11 is a timing chart showing the process of the display control apparatus according to the first embodiment of the present invention.
Figure 12:
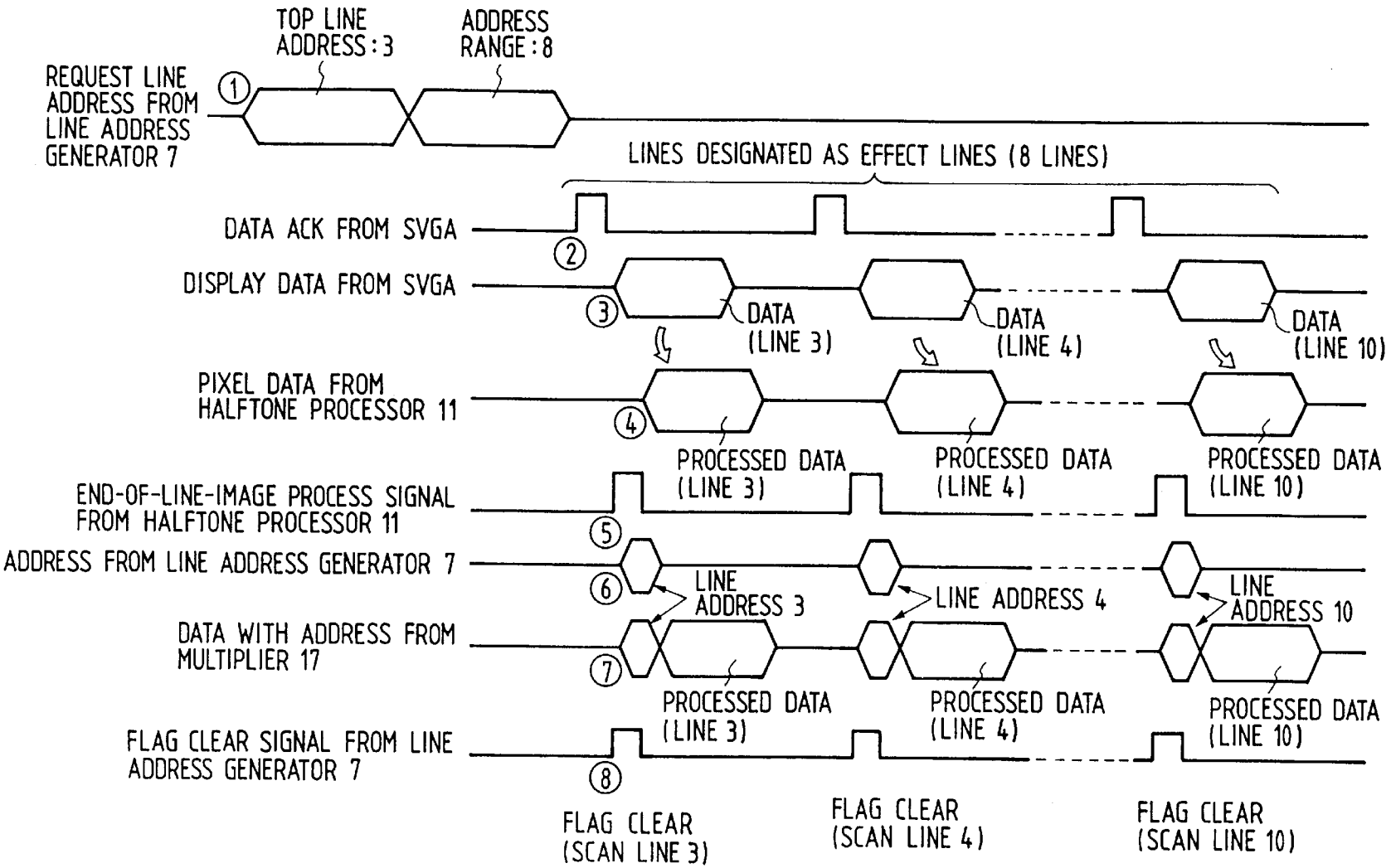
FIG. 12 is a timing chart of respective signals and data in display control processing according to the first embodiment.

FIGS. 10 and 11 are flow charts mainly showing the flow of a partial rewrite process, and FIG. 12 is a timing chart of the respective signals and data.

Figure 13:
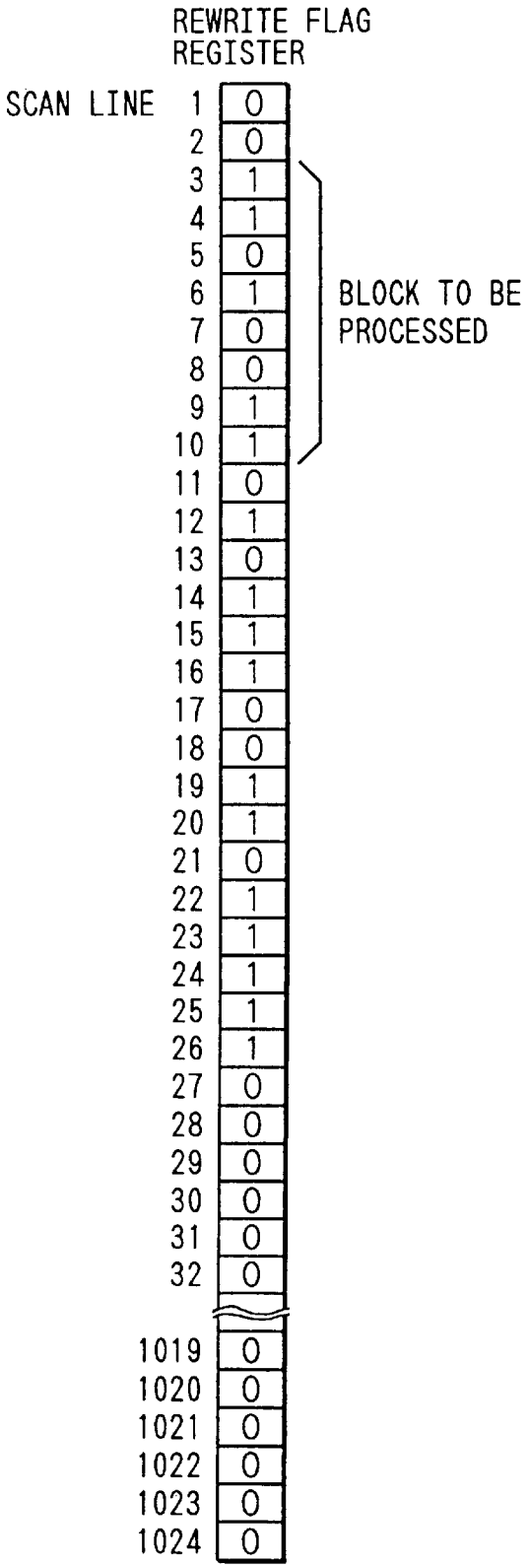
FIG. 13 is a view illustrating a rewrite flag register to explain a line block set in image processing according to the first embodiment.

In step S11 of FIG. 10, eight lines are set from the host CPU 21 to the effect line register 19 through the system bus, and t is set in the timer 18. In step S12, the value of the effect line register 19 is transferred to the line address generator 7. In step S13, the line address generator 7 clears all the bits of the rewrite flag register to "0". In step S14, the SVGA 1 writes the display data in the VRAM in accordance with the designation from the host CPU. At the same time, the SVGA 1 informs the rewrite detector/flag generator 5 of the rewritten line address. In addition, in step S15, the rewrite detector/flag generator 5 decodes the line address and distributes the line address to the respective bits of the rewrite flag, so that the designated bits go to "1". In this manner, the rewrite flag register corresponding to the rewrite address of the VRAM 3 is set. The contents of the rewrite flag registers for scan line 1 to scan line 1024 shown in FIG. 13.

In step S16, the CPU 9 scans the rewrite flag registers from scan line 1 to scan line 1024. In step S17, the CPU 9 informs the line address generator 7 of the start line address which is set at "1" for the first time. In this case, "1" is detected at line address 3 for the first time. In step S18, the line address generator 7 informs the following data, i.e., top line address: 3; and effect line: 8, to the SVGA 1 (time ① in FIG. 12; only the time will be referred to hereinafter). In step S19, if (Top line Address)+(Effect Line)≧1024, then the effect lines are reduced to obtain this value to 1,024.

In step S20, the SVGA 1 outputs a data ACK signal (time ②) and the display data of line 3 (time ③). In step S21, the halftone processor 11 outputs completely processed pixel data (time ④) and an end signal (time ⑤). That is, the halftone processor 11 outputs the processed pixel data and the end-of-process signal. The halftone processor 11 performs the binary process in accordance with the error diffusion method. The binary process error of line address 3 is diffused in the range of addresses set in the effect line register, i.e., eight lines from top line address 3 to line address 10.

Simultaneously with output of the pixel data, the line address generator 7 outputs the address of line 3 to an address multiplier 17 (time ⑥) and clears the flag of scan line 3 in the rewrite flag register (time ⑧) in step S22. In step S23, the multiplier 17 synthesizes the address of line 3 with the pixel data and sends it as addressed data to the FLCD 20 (time ⑦).

Figure 14:
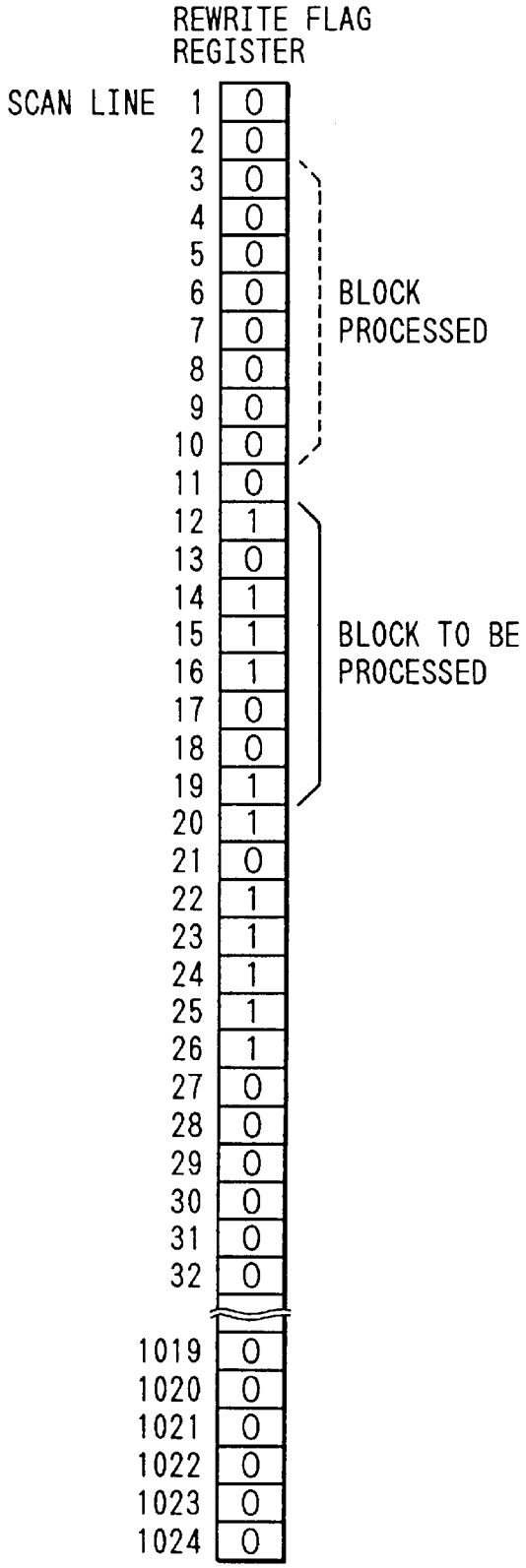
FIG. 14 is a view illustrating the rewrite flag register to explain a block next to the above block.

Steps S19 to S23 are repeated for eight lines as the effect lines. As shown in FIG. 14, the display data of line 3 to line 10 are image-processed (binarized), and at the same time their flags are cleared.

Figure 15:
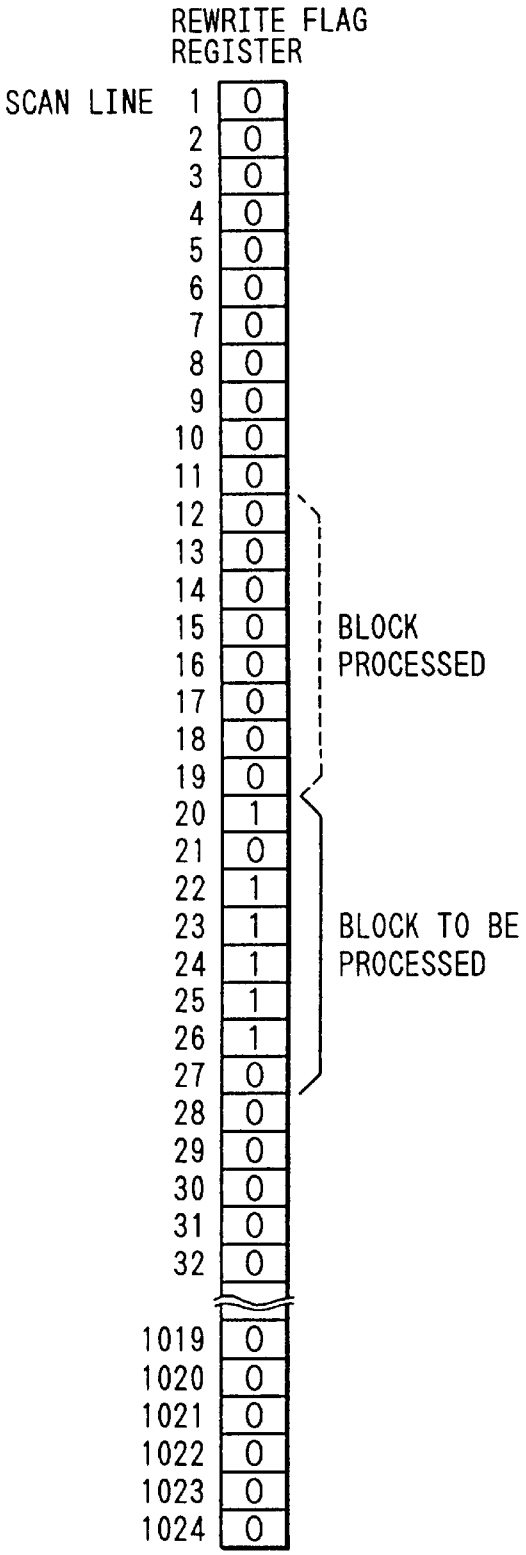
FIG. 15 is a view illustrating the rewrite flag register to explain a block next to the block in FIG. 14.

It is determined in step S25 whether "1" is set in the rewrite flag register. If YES in step S25, the flow returns to step S16 to cause the CPU 9 to detect the first "1" in a bit of the line. Steps S19 to S23 are repeated. As a result, as shown in FIG. 15, display data from line 12 to line 19 are binarized, and their flags are cleared.

If it is determined in step S25 that no "1" is set in the flag register, and a predetermined period of time of the timer 18 has elapsed, the CPU performs a process every eight lines starting from line 1, thereby performing a refresh operation (step S26). The CPU repeats steps S18 to S23 until all the lines are refreshed. If a rewrite operation by the host CPU 21 is requested during the refresh operation, the refresh operation is interrupted, and the flow returns to step S14. The partial rewrite operation is started (step S27).

Second Embodiment

Unlike in the first embodiment, rewrite flag registers for all lines of binary blocks are not cleared, and only the rewrite flag of the top line of the block is cleared.

For example, in place of step S22 in FIG. 11, the following process is performed. More specifically, a line address generator (FIGS. 3A and 3B) outputs a flag clear signal to the rewrite detector/flag generator 5 only when the line address of the top line of the block is output to a line address multiplier 17 (FIGS. 3A and 3B).

Figure 16:
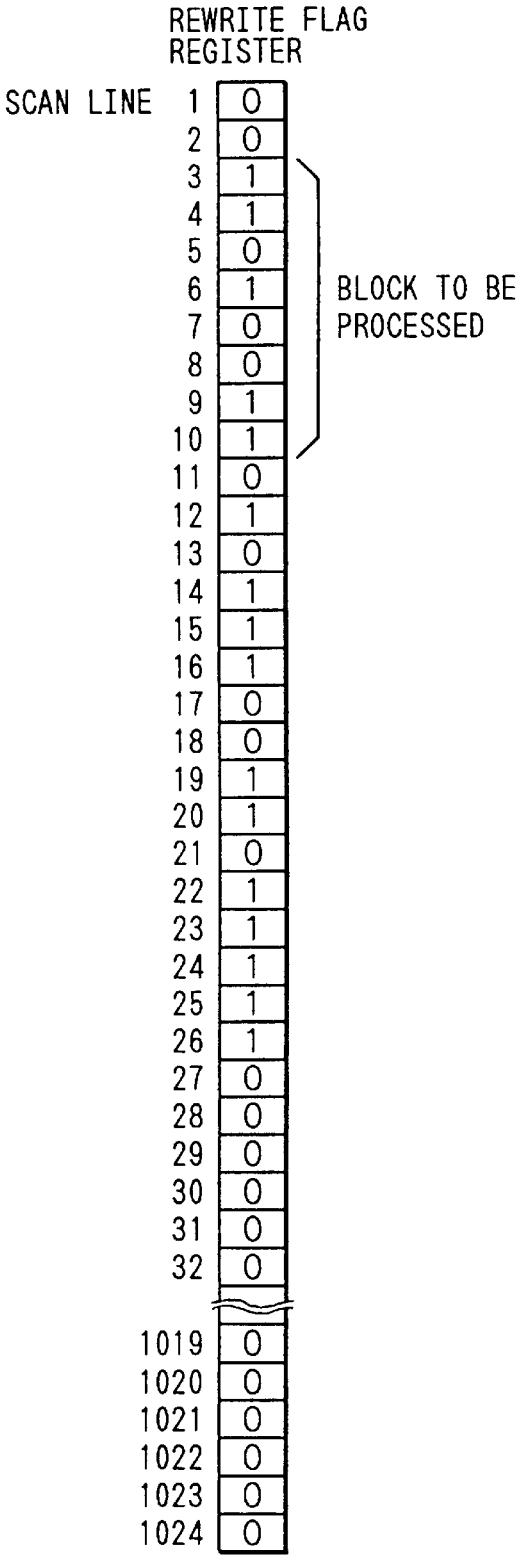
FIG. 16 is a view illustrating the rewrite flag register to explain a line block set in image processing according to the second embodiment of the present invention.
Figure 17:
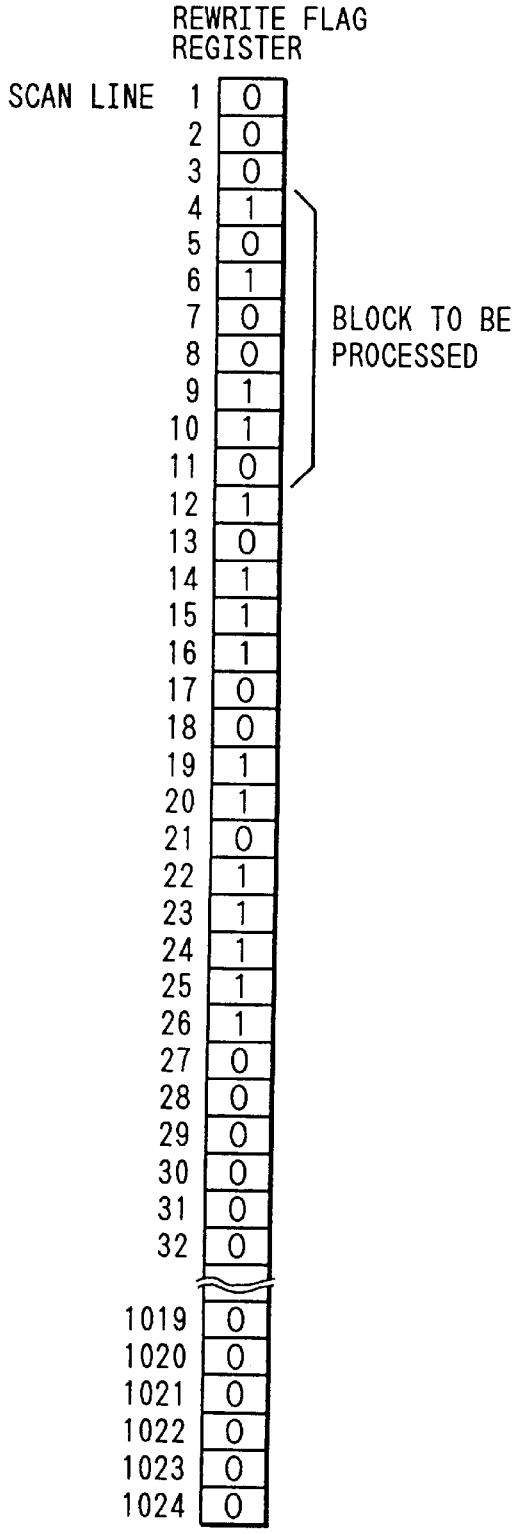
FIG. 17 is a view illustrating the rewrite flag register to explain a block next to the above block.
Figure 18:
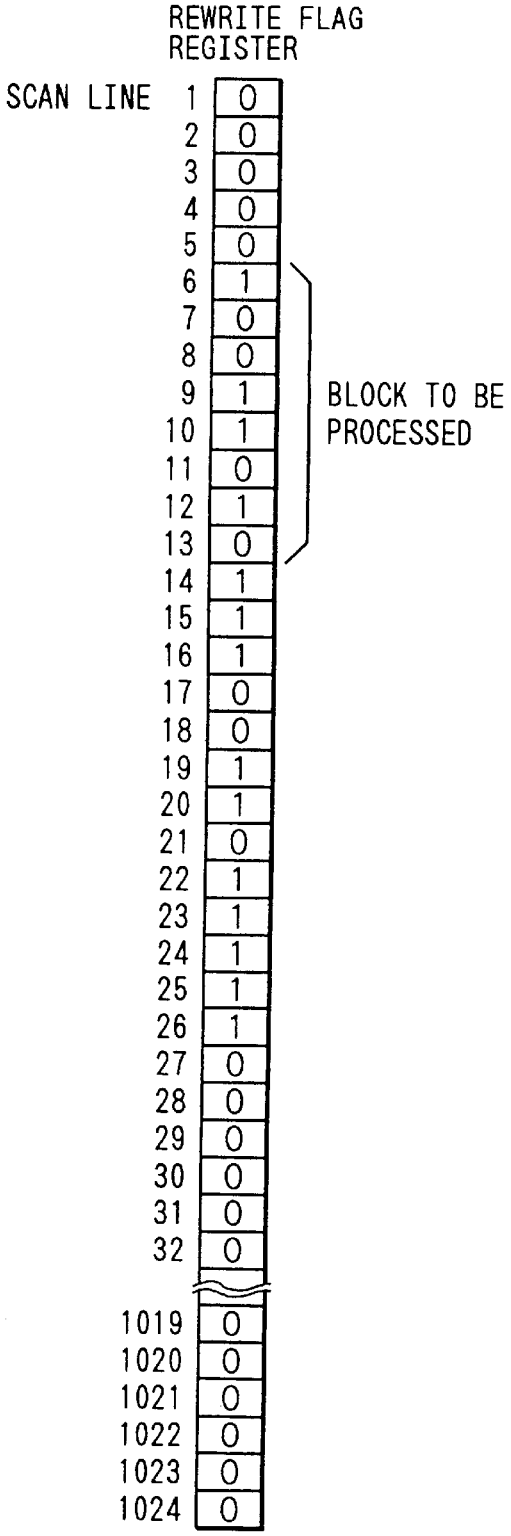
FIG. 18 is a view illustrating the rewrite flag register to explain a block next to the block in FIG. 17.

As a result, for example, if the first block to be image-processed is the one (FIG. 16) in the rewrite flag register, subsequent blocks shown in FIGS. 17 and 18 are obtained in accordance with the above process. That is, only the flag of top line 3 of the block shown in FIG. 16 is cleared, and the head line of the next block to be processed is shifted to line 4, as shown in FIG. 17. In the process of this block, only the flag of top line 4 is cleared, and the top line of the block to be processed becomes line 6.

By the above process, the error diffusion range can have fine steps to more suitably perform the binary process.

Third Embodiment

The effect lines in error diffusion in each of the first and second embodiments have only one direction, i.e., the downward direction of the scan lines. However, in the third embodiment, effect lines have both upward and downward directions.

In correspondence with this, the effect line register 19 in FIG. 3B comprises upward and downward effect line registers.

Figure 19:
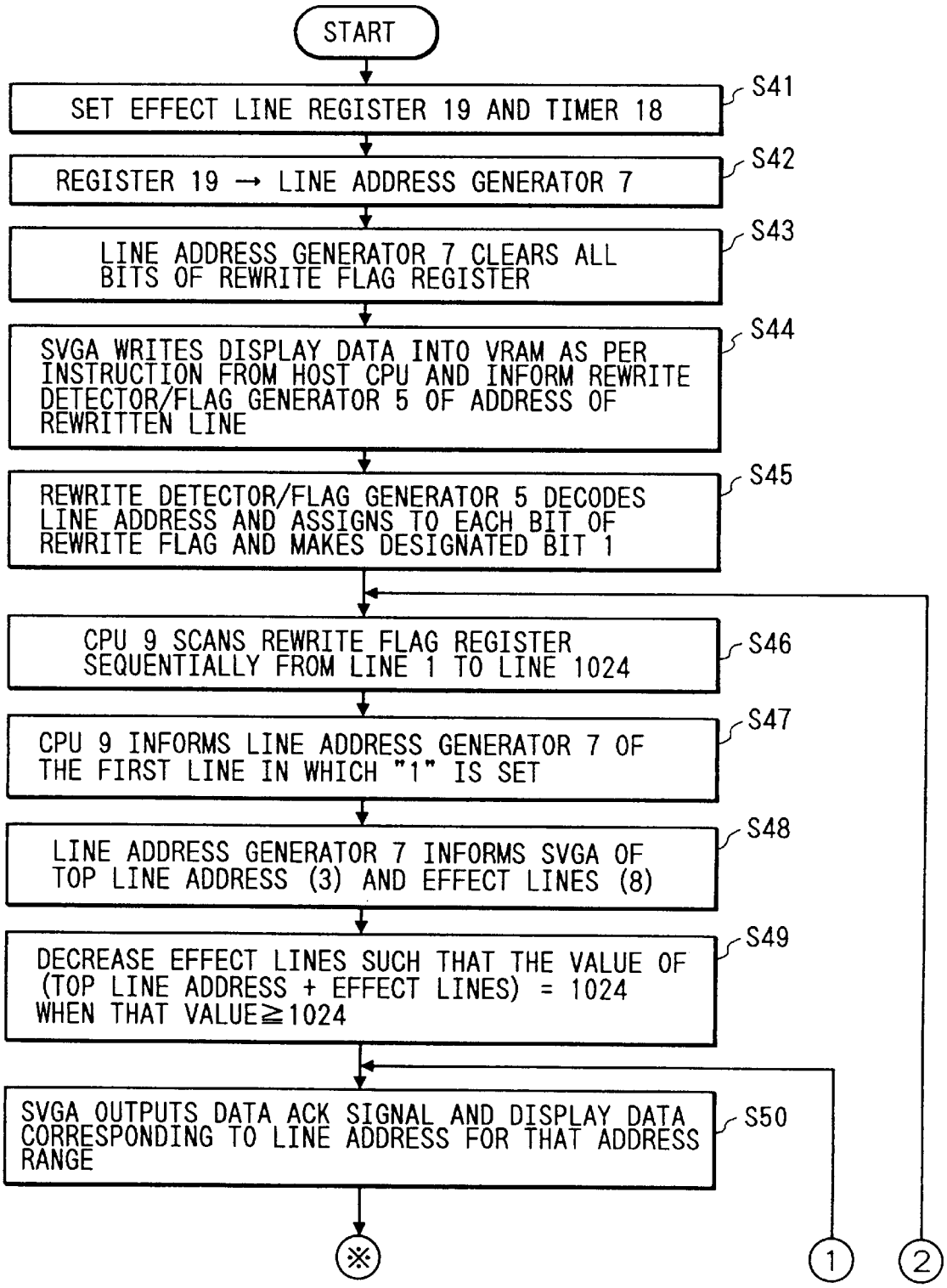
FIG. 19 is part of a flow chart showing the flow of a display control process according to third embodiment of the present invention.
Figure 20:
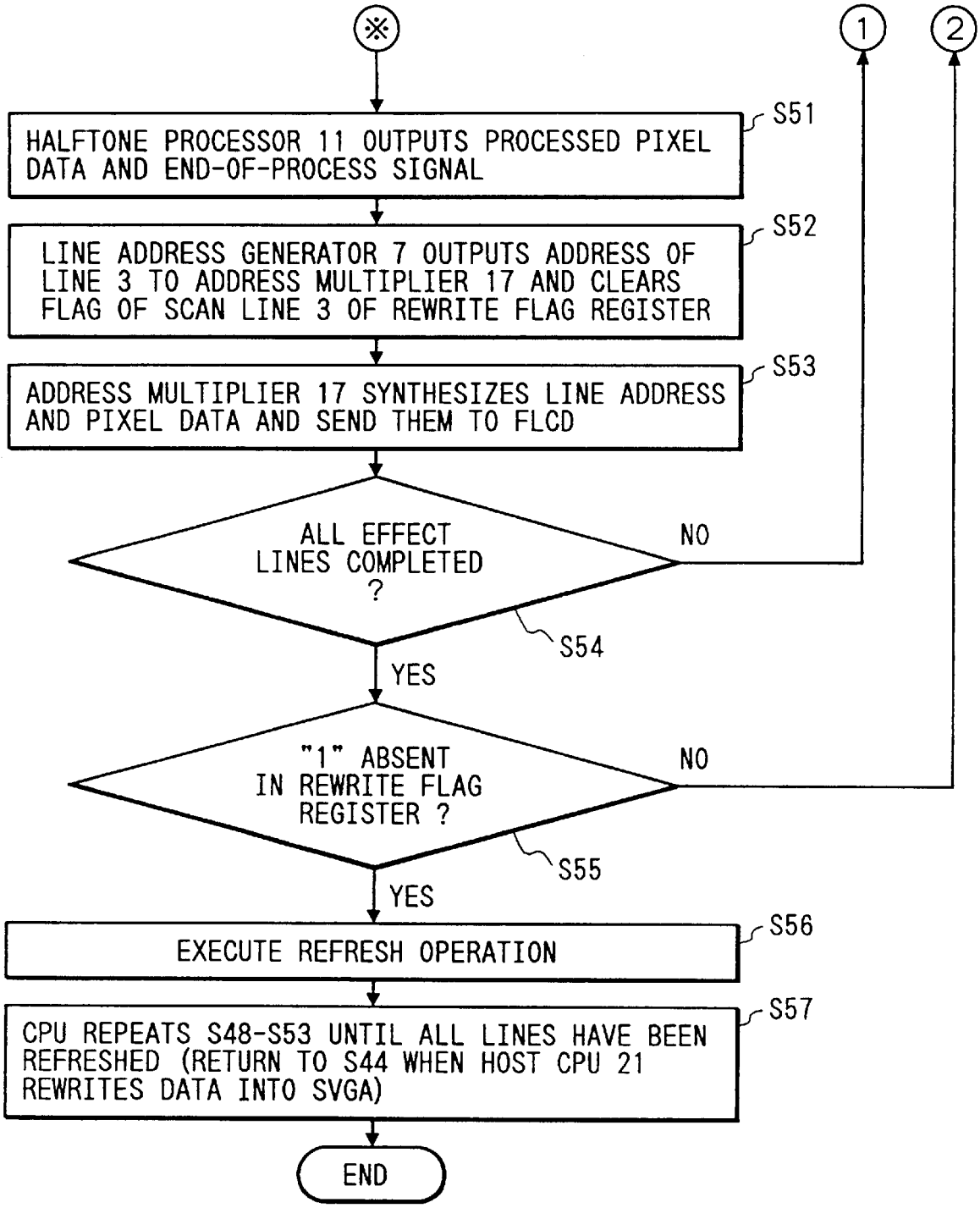
FIG. 20 is another part of a flow chart showing the flow of the display control process according to third embodiment of the present invention.

FIGS. 19 and 20 are flow charts showing the flow of a display control process according to the third embodiment of the present invention. The process in FIGS. 19 and 20 is substantially the same as that in FIGS. 10 and 11 of the first embodiment, except for steps S41 and S51.

That is, in step S41, a host CPU sets values of the upward and downward effect line registers and a timer through a system bus. In step S51, a processor 11 performs a binary process of blocks of lines designated by both the upward and downward effect line registers in accordance with the error diffusion method and outputs processed data every line. In this case, an end-of-line-image process signal representing the head of the line data is added to the processed data.

Figure 21:
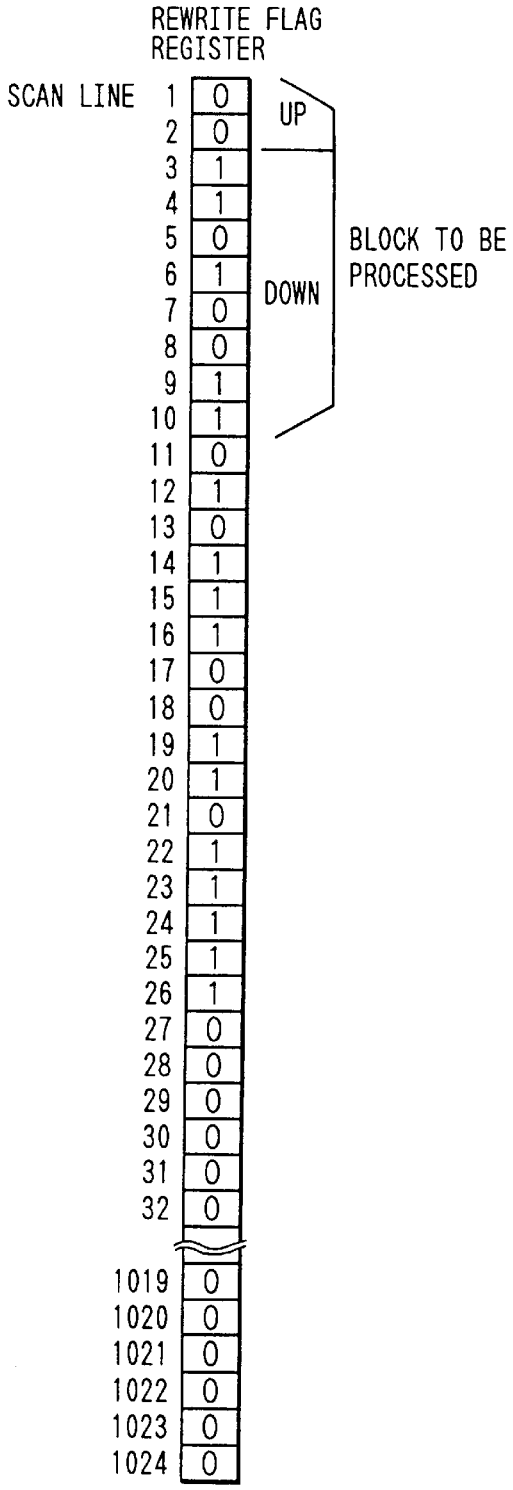
FIG. 21 is a view illustrating a rewrite flag register to explain a line block set in the image process according to the third embodiment.

In the above process, for example, if a value representing two lines is set in the upward effect line register and a value representing two lines is set in the downward effect line register, the range between the top line address and the effect lines which is determined by the process in steps S47 and S48 in FIG. 19 is shown in, e.g., FIG. 21. In this case, the top line is line 3, and the effect lines consist of two upper lines and eight lower lines with respect to line 3.

Figure 22:
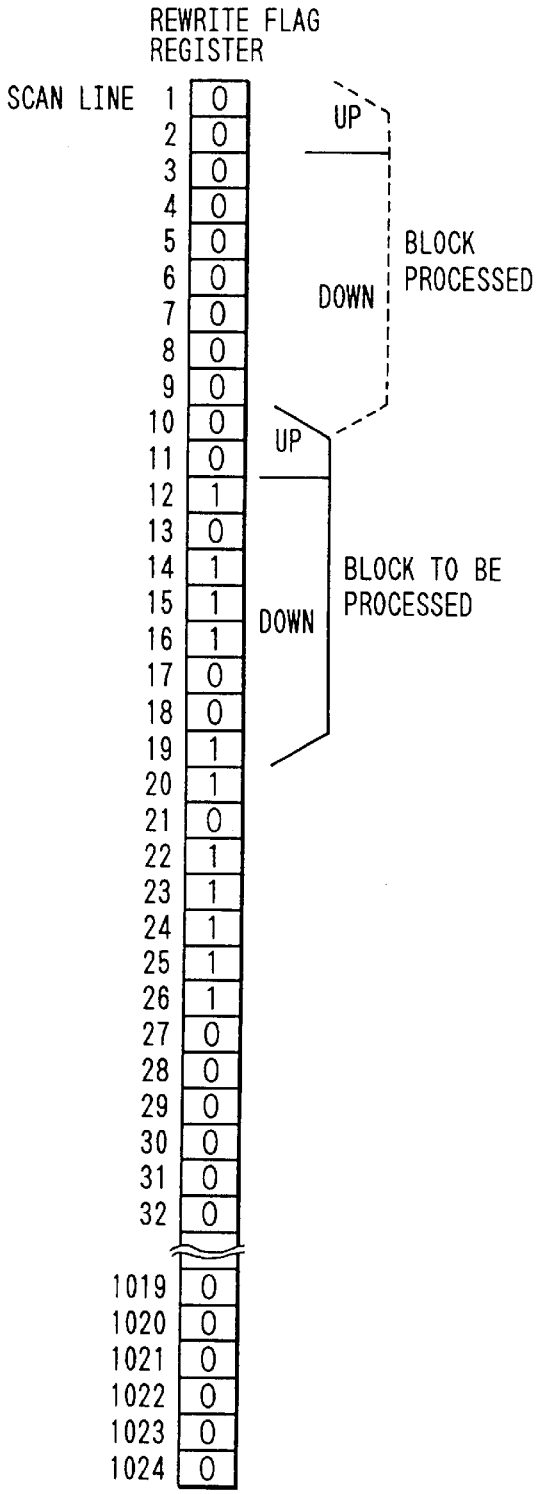
FIG. 22 is a view illustrating the rewrite flag register to explain a block next to the above block.
Figure 23:
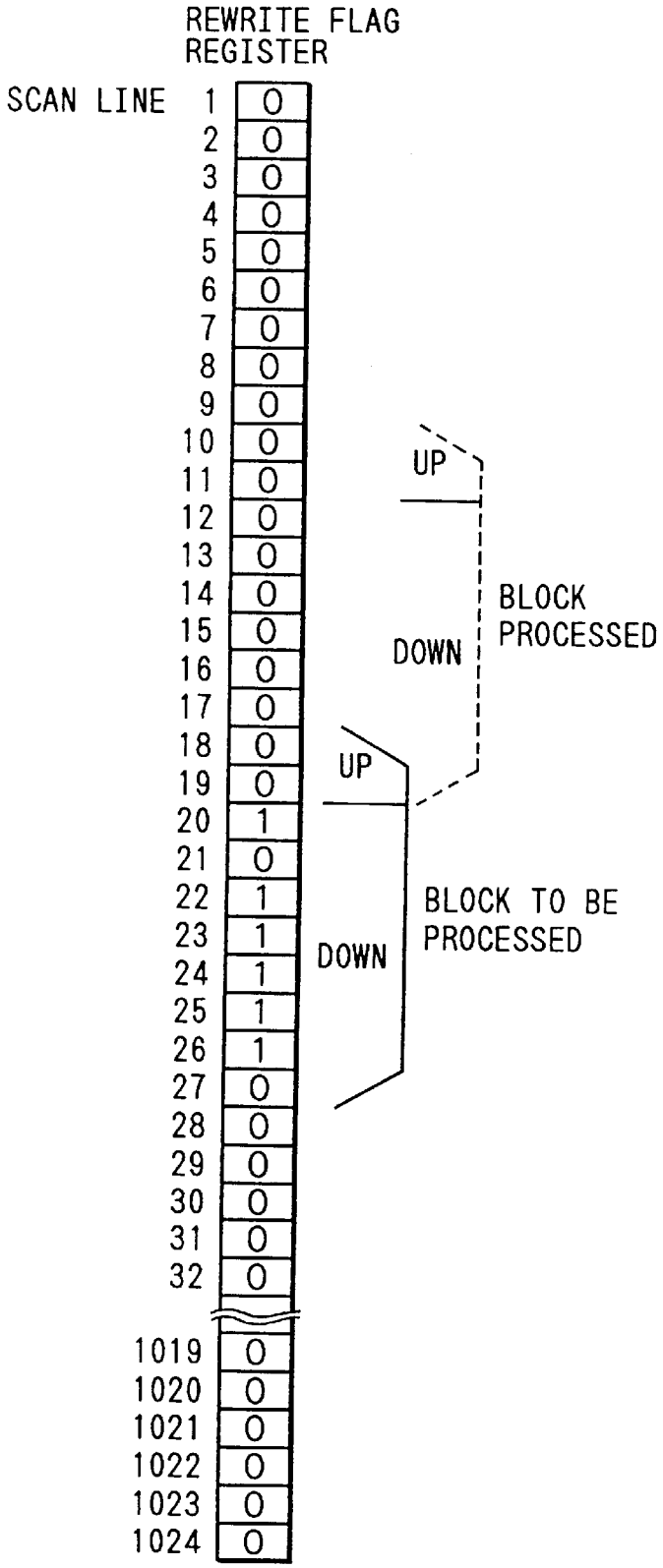
FIG. 23 is a view illustrating the rewrite flag register to explain a block next to the block shown in FIG. 22.

First of all, the block to be processed is processed in the same manner as in the first embodiment to set all the flags of this block to "0"s, and the next block becomes as shown in FIG. 22. The top line is line 12, and the effect lines consist of two upper lines and eight lower lines with respect to line 12. In the next block, the top line is line 20, as shown in FIG. 23.

As described above, according to the process of the third embodiment, overlapping portions are formed between the blocks, and a difference in image quality at the boundary of the adjacent blocks in the display image is not noticeable.

Fourth Embodiment

In this embodiment, the effect area of error diffusion is also set in the scan direction of scan lines due to the following main reason.

For example, if one of two windows is to be partially rewritten in the display of the two windows, the effect area of error diffusion is set above and below the line according to the first to third embodiments, and the effect area is not set in the line scan direction. For this reason, the other window is adversely affected by error diffusion to degrade the image quality. In this embodiment, the effect area is also set in the scan direction to prevent the other window from being adversely affected.

To perform the above process, a scan direction area register is arranged in addition to the effect line register 19 in FIG. 3. The scan direction area register is a register corresponding to, e.g., the start and end points of an area.

Figure 24:
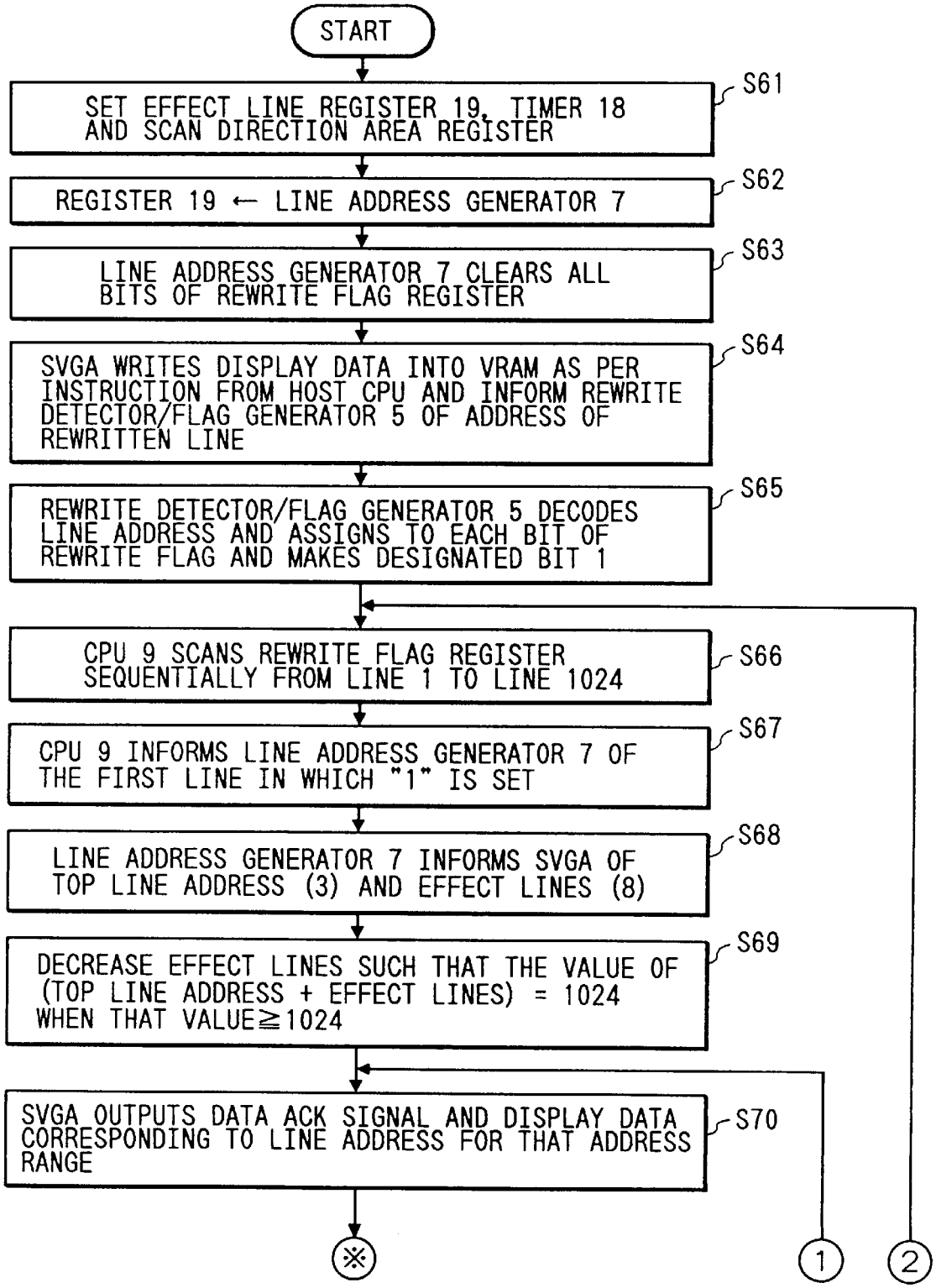
FIG. 24 is part of a flow chart showing the flow of a display control process according to fourth embodiment of the present invention.
Figure 25:
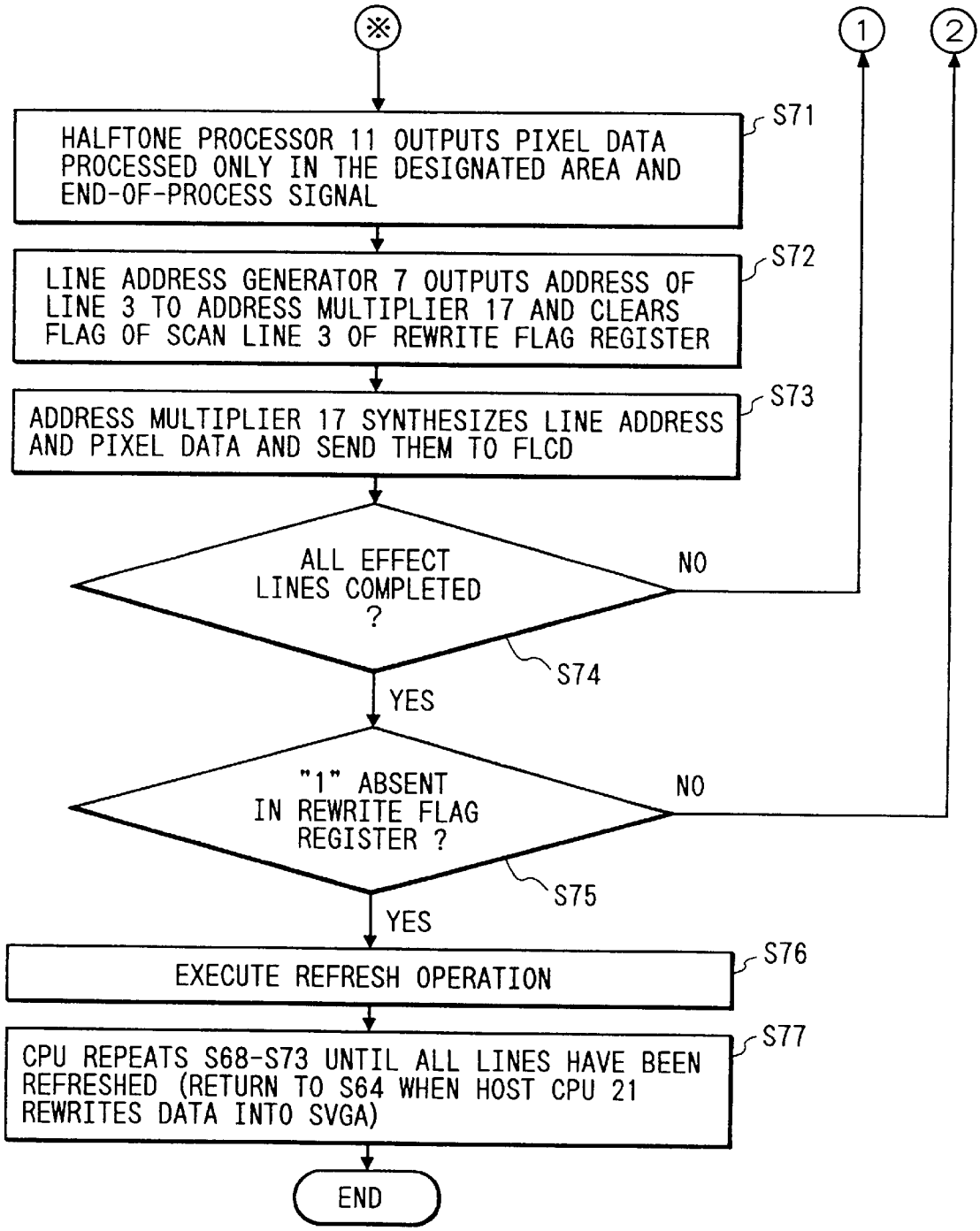
FIG. 25 is another part of a flow chart showing the flow of the display control process according to fourth embodiment of the present invention.
Figure 26:
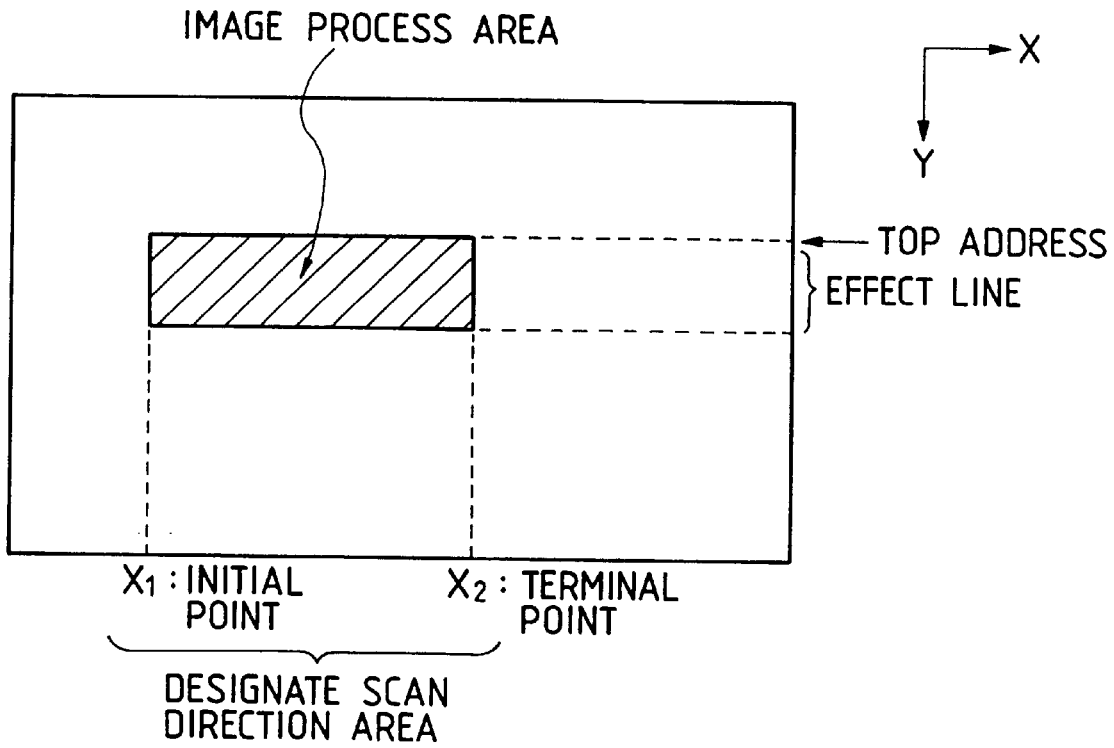
FIG. 26 is a view illustrating a display data area to explaining image process area setting according to the fourth embodiment.

FIGS. 24 and 25 are flow charts showing a display control process according to this embodiment. The process in FIGS. 24 and 25 is substantially the same as that of the first embodiment in FIGS. 10 and 11, except for steps S61 and S71. In step S61, in addition to settings of the effect lines and the timer, the start and end points of the scan direction area must also be set from the host CPU through a system bus. In step S71, the halftone process is performed in only an area designated by the effect line register and the scan direction area register, and the processed data is output for each line. At this time, an end-of-line-image process signal representing the top of the line data is added to the processed data. A image process area designated as described above is shown in FIG. 26.

According to the display control of the first to fourth embodiments described above and, particularly, partial rewrite display control, the rewrite line always becomes the top line of this block. As compared with the conventional case, lines which are not rewritten in the binary process in units of blocks need not be binarized.

Figure 27:
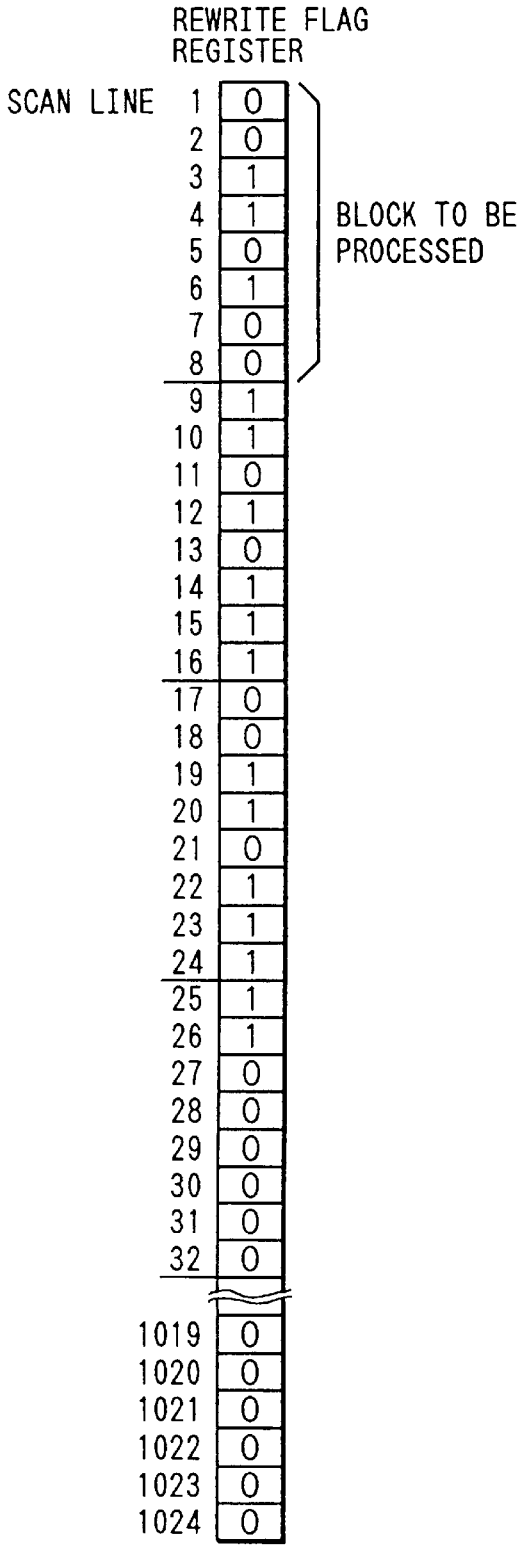
FIG. 27 PRIOR ART
FIG. 27 is a view illustrating a rewrite flag register to explain a line block set in a conventional image process as a comparative example.
Figure 28:
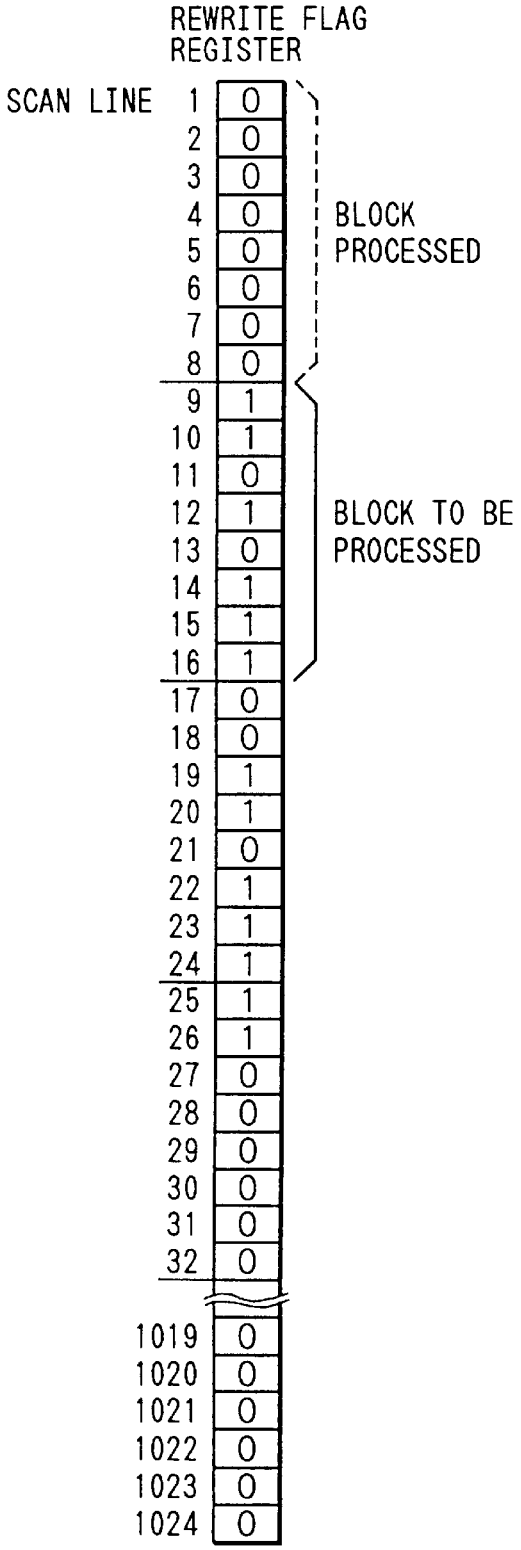
FIG. 28 PRIOR ART
FIG. 28 is a view illustrating the rewrite flag register to explain a block next to the above block.
Figure 29:
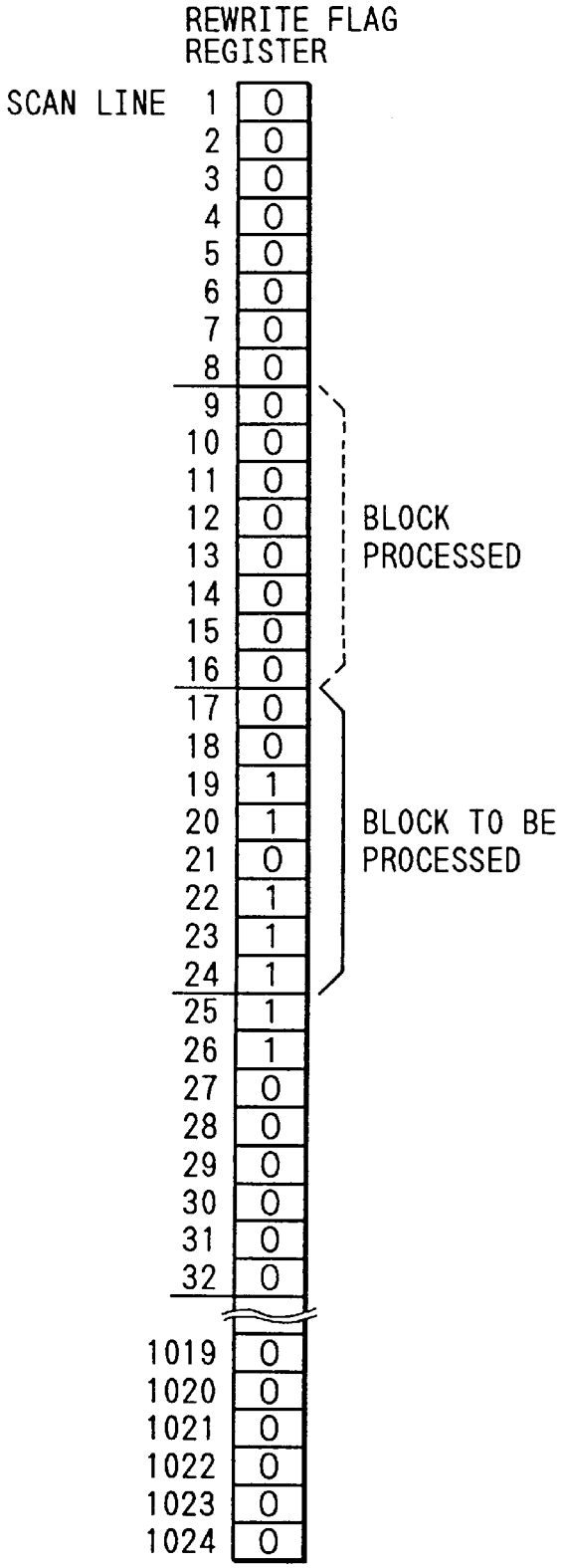
FIG. 29 PRIOR ART
FIG. 29 is a view illustrating the rewrite flag register to explain a block next to the block shown in FIG. 28.

For example, FIGS. 27 to 29 show a conventional block binary process method. According to this method, a block to be processed is always fixed. For this reason, as shown in FIG. 29, the two first lines of the block are lines which are not rewritten, but are processed to degrade the binary process. To the contrary, according to the present invention, the binary process can be efficiently performed.

As has been apparent from the above description, according to the present invention, when display data is binarized in units of blocks, the first display data of the block is always rewritten for display.

As a result, the halftone process in partial rewrite display can be properly performed.

What is claimed is:

1. A display control apparatus comprising:

storage means for storing display data at each pixel position corresponding to a display screen of a display device, the display screen having a plurality of lines and each line containing a plurality of the pixel positions;

flag registry means having a plurality of flag positions, each flag position corresponding to a respective first number of the lines starting at a respective first line, each flag position storing a respective settable flag that is normally reset;

flag setting means for setting, upon storage of display data in said storage means at the pixel positions corresponding to the first number of lines starting at a variably selected one of the first lines, the flag in the flag position that corresponds to the selected first line;

line setting means for setting a second number of lines, equal to the first number of lines plus a non-zero third number of lines; and data supply means, responsive to the set flag, for supplying, to the display device from said storage means, the display data at the pixel positions corresponding to the second number of lines starting at the selected first line.

2. An apparatus according to claim 1, wherein when the display data is read out from the pixel positions corresponding to a line for which the respective flag is set, said apparatus resets the respective flag.

3. An apparatus according to claim 1, further comprising means for binarizing the display data supplied by said data supply means.

4. An apparatus according to claim 1, wherein the display screen is a ferroelectric liquid crystal display screen.

5. A display control method comprising:

a first storing step of storing, in storage means having a plurality of pixel positions, display data at each pixel position corresponding to a display screen of a display device, the display screen having a plurality of lines and each line containing a plurality of the pixel positions;

a second storing step of storing, in flag registry means having a plurality of flag positions, each flag position corresponding to a respective first number of the lines starting at a respective first line, a respective settable flag that is normally reset in each flag position;

a flag setting step of setting, upon storage of display data in the storage means at the pixel positions corresponding to the first number of lines starting at a variably selected one of the first lines, the flag in the flag position that corresponds to the selected first line;

a line setting step of setting a second number of lines, equal to the first number of lines plus a non-zero third number of lines; and a data supply step, responsive to the set flag, of supplying, to the display device from the storage means, the display data at the pixel positions corresponding to the second number of lines starting at the selected first line.

6. A method according to claim 5, wherein when the display data is read out from the pixel positions corresponding to a line for which the respective flag is set, said method resets the respective flag.

7. A method according to claim 5, further comprising a step of binarizing the display data supplied at said data supply step.

8. A method according to claim 5, wherein the display screen is a ferroelectric liquid crystal display screen.

9. An information processing apparatus comprising:

a display device having a display screen for displaying display data, said display screen having a plurality of lines and each line containing a plurality of pixel positions;

storage means for storing display data at each pixel position corresponding to said display screen of said display device;

flag registry means having a plurality of flag positions, each flag position corresponding to a respective first number of the lines starting at a respective first line, each flag position storing a respective settable flag that is normally reset;

flag setting means for setting, upon storage of display data in said storage means at the pixel positions corresponding to the first number of lines starting at a variably selected one of the first lines, the flag in the flag position that corresponds to the selected first line;

line setting means for setting a second number of lines, equal to the first number of lines plus a non-zero third number of lines;

data supply means, responsive to the set flag, for supplying, to said display device from said storage means, the display data at the pixel positions corresponding to the second number of lines starting at the selected first line; and display control means for displaying the supplied display data on said display screen.

10. An apparatus according to claim 9, wherein when the display data is read out from the pixel positions corresponding to a line for which the respective flag is set, said information processing apparatus resets the respective flag.

11. An apparatus according to claim 9, further comprising means for binarizing the display data supplied by said data supply means.

12. An apparatus according to claim 9, wherein said display screen is a ferroelectric liquid crystal display screen.

13. A computer readable storage medium for causing a programmable apparatus to perform a display control method, said method comprising:

a first storing step of storing, in storage means having a plurality of pixel positions, display data at each pixel position corresponding to a display screen of a display device, the display screen having a plurality of lines and each line containing a plurality of the pixel positions;

a second storing step of storing, in flag registry means having a plurality of flag positions, each flag position corresponding to a respective first number of the lines starting at a respective first line, a respective settable flag that is normally reset in each flag position;

a flag setting step of setting, upon storage of display data in the storage means at the pixel positions corresponding to the first number of lines starting at a variably selected one of the first lines, the flag in the flag position that corresponds to the selected first line;

a line setting step of setting a second number of lines, equal to the first number of lines plus a non-zero third number of lines; and a data supply step, responsive to the set flag, of supplying, to the display device from the storage means, the display data at the pixel positions corresponding to the second number of lines starting at the selected first line.

14. A storage medium according to claim 13, wherein when the display data is read out from the pixel positions corresponding to a line for which the respective flag is set, said method resets the respective flag.

15. A storage medium according to claim 13, said method further comprising a step of binarizing the display data supplied at said data supply step.

16. A storage medium according to claim 13, wherein the display screen is a ferroelectric liquid crystal display screen.

* * * * *

UNITED STATES PATENT AND TRADEMARK OFFICE

CERTIFICATE OF CORRECTION

PATENT NO. :6,075,508

DATED : April 16, 1997

INVENTOR(S) :

KENICHIRO ONO; ET AL.

It is certified that error appears in the above-identified patent and that said Letters Patent is hereby corrected as shown below:

COLUMN 1:

Line 20, "is" should be deleted.

COLUMN 3:

Line 62, "third" should read --the third--; and

Line 66, "third" should read --the third--.

COLUMN 4:

Line 9, "fourth" should read --the fourth--;

Line 12, "fourth" should read --the fourth--; and

Line 15, "explaining" should read --explain--.

COLUMN 5:

Line 28, "invention;" should read --invention.--.

UNITED STATES PATENT AND TRADEMARK OFFICE

CERTIFICATE OF CORRECTION

PATENT NO. : 6,075,508

DATED : April 16, 1997

INVENTOR(S) : KENICHIRO ONO; ET AL.

It is certified that error appears in the above-identified patent and that said Letters Patent is hereby corrected as shown below:

COLUMN 8:

Line 8, "boarder" should read --border--.

COLUMN 10:

Line 23, "FIG 3." should read --FIG. 3B.--; and

Line 36, "A" should read --An--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*